US008158206B2

(12) United States Patent
Van Rhijn et al.

(10) Patent No.: US 8,158,206 B2
(45) Date of Patent: Apr. 17, 2012

(54) METHOD FOR MODIFYING WOOD AND WOOD THEREBY OBTAINED

(75) Inventors: Wim Van Rhijn, Beerse (BE); Hans E. Hoydonckx, Geel (BE); Willy Van Rhijn, Kasterlee (BE)

(73) Assignee: Transfurans Chemicals, Geel (BE)

( * ) Notice: Subject to any disclaimer, the term of this patent is extended or adjusted under 35 U.S.C. 154(b) by 686 days.

(21) Appl. No.: 12/305,080

(22) PCT Filed: Jun. 18, 2007

(86) PCT No.: PCT/EP2007/056020

§ 371 (c)(1), (2), (4) Date: Dec. 16, 2008

(87) PCT Pub. No.: WO2007/147804

PCT Pub. Date: Dec. 27, 2007

(65) Prior Publication Data

US 2010/0062276 A1 Mar. 11, 2010

(30) Foreign Application Priority Data

Jun. 21, 2006 (EP) ..... 06447083

(51) Int. Cl.
*B05D 3/02* (2006.01)

(52) U.S. Cl. ..... 427/393; 427/397

(58) Field of Classification Search ..... None
See application file for complete search history.

(56) References Cited

U.S. PATENT DOCUMENTS

| | | | | |
|---|---|---|---|---|
| 2,861,979 | A | 11/1958 | Harvey et al. | |
| 2,909,450 | A * | 10/1959 | Goldstein | 427/244 |
| 4,376,745 | A | 3/1983 | Johns | |
| 5,977,168 | A | 11/1999 | Konishi et al. | |
| 2002/0091154 | A1 * | 7/2002 | Konishi et al. | 514/471 |

FOREIGN PATENT DOCUMENTS

| | | |
|---|---|---|
| GB | 846680 | 8/1960 |
| GB | 1 509 729 | 5/1978 |
| WO | WO 01/87560 | 11/2001 |
| WO | WO 2004/011214 | 2/2004 |
| WO | WO 2005/018889 | 3/2005 |

OTHER PUBLICATIONS

International Search Report dated Sep. 12, 2007, for PCT/EP2007/056020.

* cited by examiner

*Primary Examiner* — Erma Cameron
(74) *Attorney, Agent, or Firm* — Knobbe, Martens, Olson & Bear, LLP

(57) ABSTRACT

A method for modifying wood includes steps of impregnating the wood followed by curing the wood at temperatures between 70 and 200° C. The impregnation composition includes di-, tri, and/or polysubstituted furan compounds.

10 Claims, 2 Drawing Sheets

METHOD FOR MODIFYING WOOD AND WOOD THEREBY OBTAINED

CROSS-REFERENCE TO RELATED APPLICATIONS

This application is the U.S. National Phase under 35 U.S.C. §371 of International Application PCT/EP2007/056020, filed Jun. 18, 2007, which claims priority to EP Application No. 06447083.4, filed Jun. 21, 2006.

TECHNICAL FIELD

The invention described herein relates to wood modification. The invention relates to the use of a composition comprising substituted furan molecules for impregnating wood. Also disclosed is a method for modifying wood comprising impregnating the wood with an aqueous solution containing substituted furan molecules, followed by a curing step wherein the wood and impregnating solution are reacted at high temperatures. The present method permits to obtain wood having improved characteristics of durability, dimensional stability and surface hardness.

BACKGROUND OF THE INVENTION

Wood can be modified and improved in properties like hardness, stiffness, strength, dimensional stability and resistance to deterioration by impregnating it with various compounds.

Currently, wood is made more durable mainly by using preservatives such as CCA. Most of these preservatives have toxicity to organisms in the environment, including humans. Even if they are well-fixed in wood, their presence presents a problem for disposal at the end-of-life. WO 2005/018889 for instance discloses a method for protecting wood against fungal degradation. The method consists of impregnating the wood with a fluid treatment agent such as for instance liquid wood smoke or wood smoke vapour containing biologically active compounds, such as for instance furan compounds. After impregnation, the impregnated wood is allowed to dry. The active compounds are not reacted in the wood. A disadvantage of such approach is that the utilized furan compounds have biocidal effects not only towards fungi but also towards other organisms in the environment.

Several approaches were designed to use more environmentally-friendly chemicals such as: i) use of water-soluble salts which have low toxicity ii) use of heat treatment such as the Plato process and iii) use of non-toxic chemicals which react with and alter the wood cell walls, making them less susceptible to deterioration (e.g. acetylation, N-methylolation, furfurylation).

Approach i) has the drawback that such salts usually leach out of wood in contact with water, limiting their usefulness. This approach is also less effective than traditional creosote and CCA treatment because of the low toxicity of these compounds, in addition higher concentrations are needed to obtain acceptable results.

Approach ii) has the drawback that such a treatment gives insufficient protection to the wood and the treated wood has poor mechanical properties.

An example of approach iii) is based on the impregnation of wood with monomeric furfuryl alcohol. Previous art used undiluted treating solution, and treated the wood to high levels of retention. The main disadvantage with this treatment is the large amount of chemical used and the resulting cost.

Furfuryl alcohol is highly water soluble and therefore easily forms a uniform solution with water which can be used to impregnate wood. However, there are several requirements needed before a useful modified wood can be made. First, after being impregnated into wood, the solution must be polymerized and reacted with wood at elevated temperatures (curing temperature) to be useful. Second, the polymerization must occur in wet or dry wood.

Chemical initiators were therefore added to the furfuryl alcohol to make it polymerize after impregnation at elevated temperatures (80-120° C.) in wet or dry wood. An example of a prior art initiator is zinc chloride. However zinc chloride has a devastating effect on cellulose degradation and thereby on the long-term strength properties of the modified wood.

New catalytic systems for furfurylation in wood were developed using for example cyclic carboxylic anhydrides. WO 02/30638 describes how to initiate furfuryl alcohol and make it polymerize and react with wood at the curing temperature. However, the initiated furfuryl alcohol from that technology does not mix well with water. Combining furfuryl alcohol and initiators causes the mixtures to separate into two components which cannot be uniformly impregnated into wood.

EP 1 341 648 describes a furan polymer impregnated wood obtained by impregnating wood with a mixture containing furfuryl alcohol monomers and one further compound. Furfuryl alcohol treated wood however suffers from loss of reactant and emission of unreacted monomers.

Woods treated with furfuryl alcohol can have problems to meet current requirements for health and safety, because of VOC emission due to unreacted components. Increasing awareness about environment and health and safety for human beings calls for extra attention in the preparation of modified wood. Increasing strictness of environmental rules demands a decrease of the emission of harmful substances. Modified wood with low VOC emissions are therefore required.

An alternative for the use of traditionally preserved woods involve tropical hardwoods. However, such woods are very expensive and supply and quality thereof are not consistent. Also, governments, NGO's and media are paying close attention to the use of products made of tropical wood in the context of environmental issues such as deforestation, scracers sources, illegal logging, etc. . . . There is therefore a need in the art for alternatives to tropical hardwoods.

In view of the above, it is clear that there remains a need in the art for an improved method for modifying wood. It is therefore a main object of the present invention to provide a modified wood having improved properties and an improved method for preparing such modified wood.

More in particular, the invention aims to provide modified wood showing lower VOC emission and a method for preparing such modified wood. The present invention further aims to provide modified wood showing improved properties as regards to durability, fire resistance, shrink efficiency, dimensional stability, surface hardness, UV stability, cracking resistance, rot resistance, decay resistance, and the like. Yet another object is to provide modified wood, which is uniform in color and density throughout the treated zone, and a method for preparation thereof.

It is further another object of the invention to provide modified wood and a method for preparation thereof, showing enhanced resistance to degradation by biological organisms such as e.g. wood decay fungi, but without showing toxic or biocidal effects towards such biological organisms.

Another object of the invention is to provide an improved composition adapted for impregnating wood and use thereof for impregnating and modifying wood. The invention further aims to provide a composition for impregnating and modifying wood having improved storage stability, such that during storing no phase separation occurs.

According to the present invention, the foregoing and other objects are attained by a product, method and uses thereof as disclosed in the patent claims.

SUMMARY OF THE INVENTION

The applicant has shown that at least some of the above mentioned problems of modified wood can be overcome by modifying wood using an impregnating composition comprising di-, tri- and/or poly-substituted furan compounds. Wood impregnated and reacted (cured) with this type of composition shows improved properties such as improved durability, dimensional stability and surface hardness. In addition, the obtained wood shows enhanced resistance against degradation by biological organisms, e.g. fungi, without exerting biocidal effects towards such organisms.

Whereas in prior art methods furfuryl alcohol, i.e. a mono substituted furan compound, or diluted furfuryl alcohol solutions in the presence of a catalyst are used as impregnation composition; the present invention discloses the use of impregnation compositions comprising di-, tri- and/or poly-substituted furan compounds, preferably but not necessarily in the presence of a catalyst. The present invention relates to polymerizable compositions: i.e. the present compositions are able to penetrate into the cell structure of wood and are subsequently polymerized in situ. The composition becomes an integral part of the wood cell-wall structure, modifies the wood cell wall and stable impregnated wood is obtained.

In a first aspect, the inventor relates to a method for modifying wood comprising the steps of a) impregnating said wood with a composition as defined herein and comprising substituted furan compounds, and b) reacting said impregnated wood at a temperature of between 70 and 200° C. during a suitable period of time. The present method does not necessitate a drying step to lower the VOC content after reaction and curing of the substituted furan compounds with wood. This results in a less expensive and more economic wood modification process than prior art processes, since no extra drying step after curing is necessary (less energy used).

In another aspect, the present invention relates to the use of a composition for impregnating and modifying (reacting or curing) wood. Said composition comprises di-, tri- and/or poly-substituted furan compounds. The present composition comprising di-, tri- and polysubstituted furan compounds has good storage stability and a good shelf life. The compounds in the composition will react with the wood only upon curing, even if initiators are present. In addition, the present composition is particularly suitable as wood impregnating solution, since wood that has been impregnated and reacted with a composition according to the present invention obtains several improved properties, as further explained below.

In another aspect, the invention relates to a wood impregnated and reacted with a composition as defined herein and comprising substituted furan compounds. The applicant has shown that wood that has been impregnated and reacted with a composition according to the present invention shows enhanced durability, fire resistance, dimensional stability, and surface hardness. Furthermore wood modified according to the present invention exhibits enhanced UV stability, cracking resistance, rot resistance and decay resistance. In addition, the present wood shows an increased lifetime, is of a consistent quality. It is further noted that the present wood is environmentally friendly, since wood that has been impregnated and reacted in accordance with the present invention has qualities which are comparable with tropical hard wood, and is therefore an ideal substitute thereof. Also, the present wood does not have toxicity to organisms in the environment, including humans. Even at the end-of-life, toxic compounds are not released from the woods according to the invention. Advantageously, the obtained modified wood is able to resist against degradation by biological organisms.

With the insight to better show the characteristics of the invention, some preferred embodiments and examples are described hereafter.

DETAILED DESCRIPTION OF THE INVENTION

Figure 1:
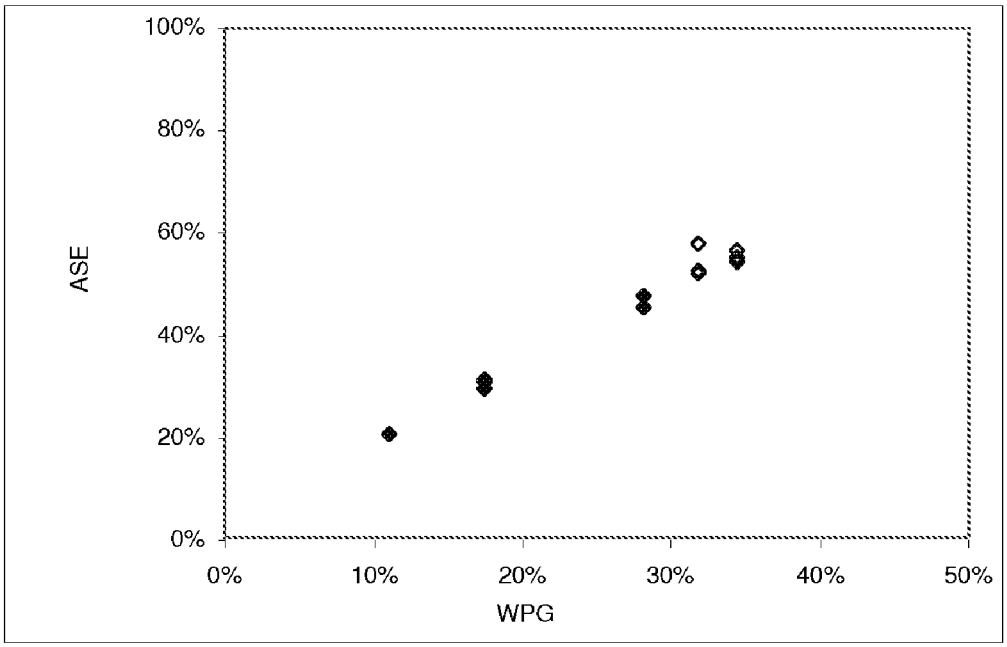
FIG. 1 illustrates ASE versus WPG values of southern yellow pine treated with a furan resin as defined herein.

The present invention relates to a polymerizable composition comprising substituted furan compounds and uses thereof for impregnating and modifying wood. The invention further relates to a method for modifying wood by reacting with the impregnation composition (solution) at elevated temperatures, the wood thereby obtained and uses of such modified wood.

In the context of the present invention the term "wood" relates to any wooden article or wooden parts, such as boards, laminates, beams, panels, veneers, frames, construction elements, and also includes parts made from wood-like fibrous material, such as plywood, laminated wood, wood-wool or ligneous fiber.

In the context of the present invention the term "impregnation" relates to activity of immersing for a certain period of time wood as defined herein in a vessel comprising a suitable composition in the presence of a solvent, e.g. of water. During the time of immersion the wood is penetrated by the composition.

The term "polymerizable" composition as used herein refers to a composition comprising compounds which are capable of forming bonds with each other to form longer chains named polymers. The present composition (and compounds comprised therein) undergoes polymerization when heated at elevated temperatures, e.g. of at least 70° C.

In the context of the present invention the term "modification" relates to chemical and structural modifications of impregnated wood. This terminology is intended to refer to the modifications that impregnated wood undergoes as a result of a polymerization of the impregnation composition. It is also noted that in some embodiments of the present invention the terms "modifying", "reacting", and "curing" (with) wood are used as synonyms.

The present invention is based on the principle that a composition as defined herein is able to impregnate wood and to penetrate into the cell structure of wood, and to be polymerized in situ. As a result thereof, the composition becomes an integral part of the wood cell-wall structure and structurally modified wood can be obtained. This type of wood modification has been classified as impregnation modification by C. A. S. Hill (Wood Modification: chemical, thermal and other processes/Callum A. S. Hill/John Wiley & Sons Ltd/West Sussex UK/2006, which is incorporated herein by reference). Impregnation modification is defined as treating the wood with a solution that diffuses into the cell wall followed by a subsequent polymerization. The filling and/or reaction of the wood cell wall with the polymerized impregnant induces the desired performance change, e.g. durability, dimensional stability, hardness, etc. . . . The polymerized impregnant is non-toxic.

In the present invention, the herein denoted di-, tri- and/or poly-substituted furan compounds are used for the first time in impregnation modification of wood.

Composition and Use Thereof

In a first aspect, the present invention relates to a polymerizable composition comprising substituted furan compounds for impregnating and modifying wood and the use thereof. After being impregnated into wood, the solution is polymerized and reacted with wood at elevated temperatures (curing temperature). The composition for impregnating wood comprises a compound of formula I and/or formula II Formula I

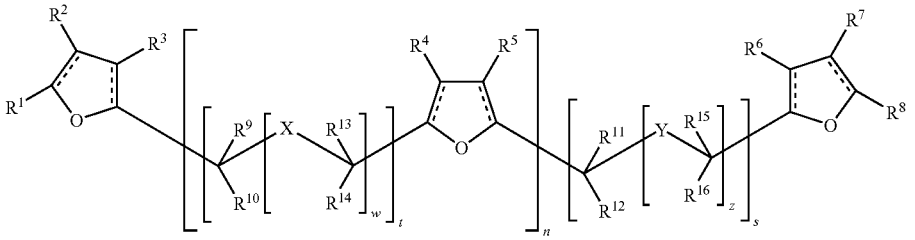

Formula II

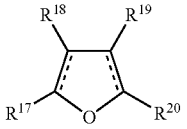

wherein n is an integer between 0 and 20, preferably between 0 and 10, and more preferably between 0 and 5 wherein t and s each independently are an integer between 1 and 20, preferably between 1 and 10, and more preferably between 1 and 5, wherein w and z each independently are 0 or 1, wherein X and Y each independently are O, S or N—$R^{21}$ and wherein $R^1$, $R^2$, $R^3$, $R^4$, $R^5$, $R^6$, $R^7$, $R^8$, $R^9$, $R^{10}$, $R^{11}$, $R^{12}$, $R^{13}$, $R^{14}$, $R^{15}$, $R^{16}$, $R^{18}$, $R^{19}$, $R^{21}$ are each independently hydrogen or selected from the group comprising $C_1$-$C_{20}$ alkyl, $C_2$-$C_{20}$ alkenyl, $C_2$-$C_{20}$ alkynyl, $C_5$-$C_{24}$ aryl, $C_5$-$C_{12}$ heteroaryl, carboxaldehyde, hydroxyl, hydroxyalkyl, carboxyl, amino, nitro, formyl, alkylamino, aminoalkyl, alkylaminoalkyl, furyl, furylalkyl, hydroxyalkylfurylalkyl, alkyloxy, alkoxyalkyl, alkenyloxy, alkylcarbonylalkenyl, oxiranyl, alkylcarbonyloxyalkyl, alkyloxycarbonylalkenyl, alkenylcarbonyloxyalkyl, isocyanate, isocyanate-alkyl, alkylcarboxy, alkenylcarboxy, alkylcarbonyl, alkenylcarbonyl, halocarbonyl, haloalkyl, haloaryl, haloalkenyl, imino, thiol, alkylthio, thioalkyl, alkylthioalkyl, cyano, alkylsulfonyl, sulfonic acid, and any mixtures thereof, whereby each group is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, alkylfuryl, hydroxyalkylfurylalkyl, isocyanate, formyl, halocarbonyl, thiol, and alkylthio, wherein $R^{17}$ and $R^{20}$ are each independently selected from the group comprising $C_1$-$C_{20}$ alkyl, $C_2$-$C_{20}$ alkenyl, $C_2$-$C_{20}$ alkynyl, $C_5$-$C_{24}$ aryl, $C_5$-$C_{12}$ heteroaryl, carboxaldehyde, hydroxyl, hydroxyalkyl, carboxyl, amino, nitro, formyl, alkylamino, aminoalkyl, alkylaminoalkyl, furyl, furylalkyl, hydroxyalkylfurylalkyl, alkyloxy, alkoxyalkyl, alkenyloxy, alkylcarbonylalkenyl, oxiranyl, alkylcarbonyloxyalkyl, alkyloxycarbonylalkenyl, alkenylcarbonyloxyalkyl, isocyanate, isocyanate-alkyl, alkylcarboxy, alkenylcarboxy, alkylcarbonyl, alkenylcarbonyl, halocarbonyl, haloalkyl, haloaryl, haloalkenyl, imino, thiol, alkylthio, thioalkyl, alkylthioalkyl, cyano, alkylsulfonyl, sulfonic acid, and any mixtures thereof, whereby each group is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, alkylfuryl, hydroxyalkylfurylalkyl, isocyanate, formyl, halocarbonyl, thiol, and alkylthio, and wherein the dotted line represents an optional double bond.

Unless defined otherwise, all technical and scientific terms used herein have the same meaning as is commonly understood by one of skill in the art. When describing the compounds of the invention, the terms used are to be construed in accordance with the following definitions, unless a context dictates otherwise.

The term "alkyl" by itself or as part of another substituent, refers to a straight or branched saturated hydrocarbon group joined by single carbon-carbon bonds having 1 to 20 carbon atoms, for example 1 to 10 carbon atoms, for example 1 to 8 carbon atoms, preferably 1 to 6 carbon atoms, more preferably 1, 2, 3 or 4 carbon atoms. When a subscript is used herein following a carbon atom, the subscript refers to the number of carbon atoms that the named group may contain. Thus, for example, $C_{1-4}$ alkyl means an alkyl of one to four carbon atoms. Examples of alkyl groups are methyl, ethyl, propyl, isopropyl, butyl, isobutyl, sec-butyl, tert-butyl, 2-methylbutyl, pentyl iso-amyl and its isomers, hexyl and its isomers, heptyl and its isomers and octyl and its isomer. When the term "alkyl" is used as a suffix following another term, as in "hydroxyalkyl," this is intended to refer to an alkyl group, as defined above, being substituted with one or two (preferably one) substituent(s) selected from the other, specifically-named group, also as defined herein. As used herein, the term $C_1$-$C_{20}$ alkyl refers to an alkyl of 1, 2, 3, 4, 5, 6, 7, 8, 9, 10, 11, 12, 13, 14, 15, 16, 17, 18, 19 or 20 carbon atoms.

The term "alkenyl" by itself or as part of another substituent, refers to a straight or branched alkyl chain containing at least one unsaturation in the form of a single carbon to carbon double bond and having 2 to 20 carbon atoms, for example 2 to 10 carbon atoms, preferably 2 to 8 carbon atoms, more preferably 2, 3 or 4 carbon atoms. Examples of alkenyl groups are ethenyl (vinyl), 2-propenyl, 2-butenyl, 3-butenyl, 2-pentenyl and its isomers, 2-hexenyl and its isomers, 2-heptenyl and its isomers, 2-octenyl and its isomers, 2,4-pentadienyl and the like. As used herein, the term $C_2$-$C_{20}$ alkenyl refers to an alkenyl of 2, 3, 4, 5, 6, 7, 8, 9, 10, 11, 12, 13, 14, 15, 16, 17, 18, 19 or 20 carbon atoms.

The term "alkynyl" by itself or as part of another substituent, refers to a straight or branched alkyl chain containing at least one unsaturation in the form of a single carbon to carbon triple bond and having 2 to 20 carbon atoms, for example 2 to 10 carbon atoms, preferably 2 to 8 carbon atoms, more preferably 2 to 6 carbon atoms, and for instance 2, 3, 4, 5 or 6 carbon atoms. Examples of alkynyl groups are ethynyl, 2-propynyl, 2-butynyl, 3-butynyl, 2-pentynyl and its isomers, 2-hexynyl and its isomers, 2-heptynyl and its isomers, 2-octynyl and its isomers and the like. As used herein, the term $C_2$-$C_{20}$ alkynyl refers to an alkynyl of 2, 3, 4, 5, 6, 7, 8, 9, 10, 11, 12, 13, 14, 15, 16, 17, 18, 19 or 20 carbon atoms.

Where alkyl groups as defined are divalent, i.e., with two single bonds for attachment to two other groups, they are termed "alkylene" groups. Non-limiting examples of alkylene groups includes methylene, ethylene, methylmethylene, trimethylene, propylene, tetramethylene, ethylethylene, 1,2-dimethylethylene, pentamethylene and hexamethylene. Similarly, where alkenyl groups as defined above and alkynyl groups as defined above, respectively, are divalent radicals having single bonds for attachment to two other groups, they are termed "alkenylene" and "alkynylene" respectively.

The term "aryl" as used herein by itself or as part of another group refers but is not limited to 5 to 24 carbon-atom homocyclic (i.e., hydrocarbon) monocyclic, bicyclic or tricyclic aromatic rings or ring systems containing 1 to 4 rings which are fused together or linked covalently, typically containing 5 to 8 atoms; at least one of which is aromatic. The aromatic ring may optionally include one to three additional rings (either cycloalkyl, heterocyclyl or heteroaryl) fused thereto. Non-limiting examples of aryl comprise phenyl, biphenylyl, biphenylenyl, 5- or 6-tetralinyl, 1-, 2-, 3-, 4-, 5-, 6-, 7- or 8-azulenyl, 1- or 2-naphthyl, 1-, 2- or 3-indenyl, 1-, 2- or 9-anthryl, 1-2-, 3-, 4- or 5-acenaphthylenyl, 3-, 4- or 5-acenaphthenyl, 1-, 2-, 3-, 4- or 10-phenanthryl, 1- or 2-pentalenyl, 1, 2-, 3- or 4-fluorenyl, 4- or 5-indanyl, 5-, 6-, 7- or 8-tetrahydronaphthyl, 1,2,3,4-tetrahydronaphthyl, 1,4-dihydronaphthyl, dibenzo[a,d]cycloheptenyl, 1-, 2-, 3-, 4- or 5-pyrenyl. As used herein, the term $C_5$-$C_{24}$ aryl refers to an aryl of 5, 6, 7, 8, 9, 10, 11, 12, 13, 14, 15, 16, 17, 18, 19, 20, 21, 22, 23, or 24 carbon atoms.

The term "heteroaryl" as used herein by itself or as part of another group refers but is not limited to 5 to 12 carbon-atom aromatic rings or ring systems containing 1 to 3 rings which are fused together or linked covalently, typically containing 5 to 8 atoms; at least one of which is aromatic in which one or more carbon atoms in one or more of these rings can be replaced by oxygen, nitrogen or sulfur atoms where the nitrogen and sulfur heteroatoms may optionally be oxidized and the nitrogen heteroatoms may optionally be quaternized. Such rings may be fused to an aryl, cycloalkyl, heteroaryl or heterocyclyl ring.

The term "hydroxyalkyl" refers to a —$R^b$—OH group wherein $R^b$ is alkylene as defined herein.

The term "amino" refers to the group —$NH_2$.

The term "alkylamino" refers to the group —$N(R^e)(R^f)$ wherein $R^e$ and $R^f$ are each independently selected from hydrogen and alkyl which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, alkylfuryl, furylalkyl, hydroxyalkylfurylalkyl, isocyanate, formyl, halocarbonyl, thiol, and alkylthio.

The term "aminoalkyl" refers to the group —$R^b$—$NH_2$ wherein $R^b$ is alkylene which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, hydroxyalkylfurylalkyl, isocyanate, formyl, halocarbonyl, thiol, and alkylthio.

The term "alkylaminoalkyl" refers to the group —$R^b$—$NR^eR^f$ wherein $R^b$ is alkylene which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, alkylfuryl, furylalkyl, hydroxyalkylfurylalkyl, isocyanate, formyl, halocarbonyl, thiol, and alkylthio, $R^e$ is hydrogen or alkyl which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, alkylfuryl, furylalkyl, hydroxyalkylfurylalkyl, isocyanate, formyl, halocarbonyl, thiol, and alkylthio, and $R^f$ is hydrogen or alkyl which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, alkylfuryl, hydroxyalkylfurylalkyl, isocyanate, formyl, halocarbonyl, thiol, and alkylthio.

The term "carboxy" is equivalent to "hydroxycarbonyl" and refers to the group —$CO_2H$. The term "alkylcarboxy" is equivalent to "alkyloxycarbonyl" and refers to the group —$CO_2$—$R^a$, wherein $R^a$ is alkyl which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, hydroxyalkylfurylalkyl, isocyanate, formyl, halocarbonyl, thiol, and alkylthio. The term "alkenylcarboxy" is equivalent to "alkenyloxycarbonyl" and refers to the group —$CO_2$—$R^c$, wherein $R^c$ is alkenyl which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, hydroxyalkylfurylalkyl, isocyanate, formyl, halocarbonyl, thiol, and alkylthio.

The term carboxaldehyde or formyl refers to the group C(=O)H.

The term "furyl" refers to the group represented by formula III:

formula III

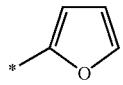

Asterisks (*) are used herein to indicate the point at which a mono-, bi- or trivalent radical depicted is connected to the structure to which it relates and of which the radical forms part.

The term "furylalkyl" refers to the group —$R^b$-furyl, wherein furyl is as defined above and $R^b$ is alkylene which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, hydroxyalkylfurylalkyl, isocyanate, formyl, halocarbonyl, thiol, and alkylthio.

The term "hydroxyalkylfurylalkyl" refers to the group —$R^b$-furyl-$R^b$—OH, wherein furyl is as defined above and $R^b$ is alkylene as defined above.

The term "alkylfuryl" refers to the group -furyl-$R^b$, wherein furyl is as defined above and $R^b$ is alkylene which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, hydroxyalkylfurylalkyl, isocyanate, formyl, halocarbonyl, thiol, and alkylthio.

The term "alkoxy" or "alkyloxy" refers to the group —O—$R^a$ wherein $R^a$ is alkyl which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, hydroxyalkylfurylalkyl, isocyanate, formyl, halocarbonyl, thiol, and alkylthio.

The term "alkoxyalkyl" or "alkyloxyalkyl" refers to the group —$R^b$—O—$R^a$ wherein $R^a$ is alkyl which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, alkylfuryl, hydroxyalkylfurylalkyl, isocyanate, formyl, halocarbonyl, thiol, and alkylthio and $R^b$ alkyl which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, hydroxyalkylfurylalkyl, isocyanate, formyl, halocarbonyl, thiol, and alkylthio.

The term "alkenyloxy" refers to the group —O—$R^b$ wherein $R^b$ is alkenyl which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, hydroxyalkylfurylalkyl, isocyanate, formyl, halocarbonyl, thiol, and alkylthio. An example is vinyl ether.

The term "alkyloxycarbonylalkenyl" refers to the group —$R^d$—C(═O)—O—$R^a$, wherein $R^d$ is alkenylene which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, hydroxyalkylfurylalkyl, isocyanate, formyl, halocarbonyl, thiol, and alkylthio, and $R^a$ is alkyl which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, alkylfuryl, hydroxyalkylfurylalkyl, isocyanate, formyl, halocarbonyl, thiol, and alkylthio.

The term "oxiranyl" refers to the epoxy group —$C_2H_3O$.

The term "alkylcarbonyl" refers to the group —C(═O)$R^a$, wherein $R^a$ is alkyl which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, alkylfuryl, hydroxyalkylfurylalkyl, isocyanate, formyl, halocarbonyl, thiol, and alkylthio. Said alkylcarbonyl can be exemplified by acetyl, propionyl, butyryl, valeryl and pivaloyl.

The term "alkenylcarbonyl" refers to the group —C(═O)$R^c$ wherein $R^c$ is alkenyl as which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, alkylfuryl, hydroxyalkylfurylalkyl, isocyanate, formyl, halocarbonyl, thiol, and alkylthio. An example hereof is vinyl ketone.

The term "alkylcarbonyloxyalkyl" refers to the group —$R^b$—O—C(═O)$R^a$ wherein $R^b$ is alkylene which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, alkylfuryl, hydroxyalkylfurylalkyl, isocyanate, formyl, halocarbonyl, thiol, and alkylthio, and $R^a$ is alkyl which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, alkylfuryl, hydroxyalkylfurylalkyl, isocyanate, formyl, halocarbonyl, thiol, and alkylthio.

The term "alkenylcarbonyloxyalkyl" refers to the group —$R^b$—O—C(═O)$R^c$ wherein $R^b$ is alkylene which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, alkylfuryl, hydroxyalkylfurylalkyl, isocyanate, formyl, halocarbonyl, thiol, and alkylthio. above and $R^c$ is alkenyl which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, alkylfuryl, hydroxyalkylfurylalkyl, isocyanate, formyl, halocarbonyl, thiol, and alkylthio.

The term "alkylcarbonylalkenyl" refers to the —$R^d$—C(═O)—$R^a$ group wherein $R^d$ is alkenylene which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, hydroxyalkylfurylalkyl, isocyanate, formyl, halocarbonyl, thiol, and alkylthio, and $R^a$ is alkyl which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, alkylfuryl, hydroxyalkylfurylalkyl, isocyanate, formyl, halocarbonyl, thiol, and alkylthio.

The term "isocyanate" refers to the group —N═C═O. The term "isocyanate-alkyl" refers to the group —$R^a$-isocyanate, wherein $R^a$ is alkylene which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, alkylfuryl, hydroxyalkylfurylalkyl, isocyanate, formyl, halocarbonyl, thiol, and alkylthio.

The term "nitro" refers to the group —$NO_2$.

The term "cyano" refers to the group —CN. The term "imino" refers to the group —C(═NH)$R^g$ wherein $R^g$ is alkyl, alkenyl or aryl which are each optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, alkylfuryl, hydroxyalkylfurylalkyl, isocyanate, formyl, halocarbonyl, thiol, and alkylthio.

The term "thiol" or "sulfhydryl" refers to the group —SH.

The term "alkylthio" refers to the group —$SR^a$ group wherein $R^a$ is alkyl which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, hydroxyalkylfurylalkyl, isocyanate, formyl, halocarbonyl, thiol, and alkylthio. This term refers to a group consisting of a sulfur atom attached to an alkyl group. Non-limiting examples of alkylthio groups include methylthio ($SCH_3$), ethylthio ($SCH_2CH_3$), n-propylthio, isopropylthio, n-butylthio, isobutylthio, sec-butylthio, tert-butylthio, n-hexylthio, and the like.

The term "thioalkyl" refers to the group —$R^b$—SH wherein $R^b$ is alkylene which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, alkylfuryl, hydroxyalkylfurylalkyl, isocyanate, formyl, halocarbonyl, thiol, and alkylthio. Non-limiting examples of thioalkyl groups include thiomethyl, thioethyl, thiopropyl, thiobutyl, thiopentyl, thiohexyl, thioheptyl, thiooctyl, thiooctadecyl, and the like.

The term "alkylthioalkyl" refers to the group —$R^b$—S—$R^a$ wherein $R^b$ is alkylene which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, alkylfuryl, hydroxyalkylfurylalkyl, isocyanate, formyl, halocarbonyl, thiol, and alkylthio and $R^a$ is alkyl which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, alkylfuryl, hydroxyalkylfurylalkyl, isocyanate, formyl, halocarbonyl, thiol, and alkylthio.

The term "sulfonic acid" refers to the group —S(=O)$_2$OH.

The term "alkylsulfonyl" refers to the group —S(=O)$_2$$R^a$ wherein $R^a$ is alkyl as which is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, alkylfuryl, hydroxyalkylfurylalkyl, isocyanate, formyl, halocarbonyl, thiol, and alkylthio.

The term "halo" or "halogen" as a group or part of a group is generic for fluoro, chloro, bromo or iodo.

The term "haloalkyl" refers to an alkyl radical having the meaning as defined above wherein one or more hydrogens are replaced with a halogen as defined above. Non-limiting examples of such haloalkyl radicals include chloromethyl, 1-bromoethyl, fluoromethyl, difluoromethyl, trifluoromethyl, 1,1,1-trifluoroethyl and the like.

The term "haloalkenyl" refers to an alkenyl radical having the meaning as defined above wherein one or more hydrogens are replaced with a halogen as defined above.

The term "halocarbonyl" refers to the group —C(=O)—Hal wherein Hal refers to a halogen as defined above. Non-limiting examples of such halocarbonyl radicals include chlorocarbonyl (—C(=O)Cl), bromocarbonyl (—C(=O)Br) or fluorocarbon (—C(=O)F).

The term "haloaryl" refers to an aryl radical having the meaning as defined above wherein one or more hydrogens are replaced with a halogen as defined above.

Whenever the term "substituted" is used in the present invention, it is meant to indicate that one or more hydrogens on the atom indicated in the expression using "substituted" is replaced with a selection from the indicated group, provided that the indicated atom's normal valency is not exceeded, and that the substitution results in a chemically stable compound, i.e. a compound that is sufficiently robust to survive isolation to a useful degree of purity from a reaction mixture.

Whenever used in the present invention the term "compounds of the invention" or a similar term is meant to include the compounds of formula I, formula II, formula II', and formula IV and V (see below) as defined herein.

The terms "composition", "impregnation composition", "impregnating solution" and "furan resin" are used herein as synonyms, and all refer to a composition comprising substituted furan compounds as defined herein.

In another preferred embodiment, the invention relates to the use of a composition as defined above, comprising furan compounds of formula I and/or formula II wherein n is an integer between 0 and 5, and preferably is 0, 1, 2, 3, 4, or 5 wherein t and s each independently are an integer between 1 and 5, and preferably each are 1 or 2, wherein w and z each independently are 0 or 1, wherein X and Y each independently are O, S or N—$R^{21}$ and wherein $R^1$, $R^2$, $R^3$, $R^4$, $R^5$, $R^6$, $R^7$, $R^8$, $R^9$, $R^{10}$, $R^{11}$, $R^{12}$, $R^{13}$, $R^{14}$, $R^{15}$, $R^{16}$, $R^{18}$, $R^{19}$, $R^{21}$ are each independently hydrogen or selected from the group comprising $C_1$-$C_{20}$ alkyl, carboxaldehyde, hydroxyalkyl, carboxyl, amino, nitro, alkylamino, aminoalkyl, alkoxyalkyl, alkylaminoalkyl, alkylcarboxy, alkenylcarboxy, furyl, furylalkyl, hydroxyalkylfurylalkyl, alkyloxy, alkenyloxy, alkylcarbonylalkenyl, oxiranyl, alkenylcarbonyl, alkylcarbonyloxyalkyl, alkyloxycarbonylalkenyl, alkenylcarbonyloxyalkyl, isocyanate, isocyanate-alkyl, alkylcarbonyl, halocarbonyl, haloalkyl, haloaryl, haloalkenyl, imino, thioalkyl, alkylthioalkyl, cyano and any mixtures thereof, and preferably from the group comprising, $C_1$-$C_{20}$ alkyl, carboxaldehyde, hydroxyalkyl, carboxyl, alkylamino, aminoalkyl, alkylaminoalkyl, alkyloxy, alkoxyalkyl, furylalkyl, hydroxyalkylfurylalkyl, alkenyloxy, alkylcarbonylalkenyl, alkenylcarbonyl, alkylcarbonyloxyalkyl, alkyloxycarbonylalkenyl, alkenylcarbonyloxyalkyl, alkylcarboxy, alkenylcarboxy, alkylcarbonyl, and any mixtures thereof, and even more preferred from the group comprising $C_1$-$C_{10}$ alkyl, carboxaldehyde, hydroxyalkyl, alkylamino, aminoalkyl, alkylaminoalkyl, alkyloxy, alkoxyalkyl, furylalkyl, hydroxyalkylfurylalkyl, carboxyl, alkenyloxy, alkylcarboxy, alkenylcarboxy, alkylcarbonyl, alkenylcarbonyl, and any mixtures thereof, and still more preferred from the group comprising $C_1$-$C_{10}$ alkyl, carboxaldehyde, hydroxyalkyl, aminoalkyl, alkylaminoalkyl, alkoxyalkyl, furylalkyl, hydroxyalkylfurylalkyl, carboxyl, and any mixtures thereof, whereby each group is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, alkylfuryl, hydroxyalkylfurylalkyl, isocyanate, formyl, halocarbonyl, thiol, and alkylthio, and wherein $R^{17}$ and $R^{20}$ are each independently selected from the group comprising $C_1$-$C_{20}$ alkyl, carboxaldehyde, hydroxyalkyl, carboxyl, amino, nitro, alkylamino, aminoalkyl, alkoxyalkyl, alkylaminoalkyl, alkylcarboxy, alkenylcarboxy, furyl, furylalkyl, hydroxyalkylfurylalkyl, alkyloxy, alkenyloxy, alkylcarbonylalkenyl, oxiranyl, alkenylcarbonyl, alkylcarbonyloxyalkyl, alkyloxycarbonylalkenyl, alkenylcarbonyloxyalkyl, isocyanate, isocyanate-alkyl, alkylcarbonyl, and any mixtures thereof, and preferably from the group comprising $C_1$-$C_{20}$ alkyl, carboxaldehyde, hydroxyalkyl, carboxyl, alkylamino, aminoalkyl, alkylaminoalkyl, alkyloxy, alkoxyalkyl, furylalkyl, hydroxyalkylfurylalkyl, alkenyloxy, alkylcarbonylalkenyl, alkenylcarbonyl, alkylcarbonyloxyalkyl, alkyloxycarbonylalkenyl, alkenylcarbonyloxyalkyl, alkylcarboxy, alkenylcarboxy, alkylcarbonyl, and any mixtures thereof, and even more preferred from the group comprising $C_1$-$C_{10}$ alkyl, carboxaldehyde, hydroxyalkyl, alkylamino, aminoalkyl, alkylaminoalkyl, carboxyl, alkyloxy, alkoxyalkyl, furylalkyl, hydroxyalkylfurylalkyl alkenyloxy, alkylcarboxy, alkenylcarboxy, alkylcarbonyl, alkenylcarbonyl, and any mixtures thereof, and still more preferred from the group comprising $C_1$-$C_{10}$ alkyl, carboxaldehyde, hydroxyalkyl, aminoalkyl, carboxyl, and any mixtures thereof, whereby each group is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, alkylfuryl, hydroxyalkylfurylalkyl, isocyanate, formyl, halocarbonyl, thiol, and alkylthio, and wherein the dotted line represents a double bond.

In another preferred embodiment the invention relates to the use of a composition comprising a compound of formula I and/or formula II, wherein n is 0, 1, 2, 3, 4 or 5 wherein t and s each independently are 1 or 2, wherein w and z each independently are 0 or 1, wherein X and Y each independently are O, S or N—$R^{21}$ and wherein $R^2$, $R^3$, $R^4$, $R^5$, $R^6$, $R^7$, $R^9$, $R^{10}$, $R^{11}$, $R^{12}$, $R^{13}$, $R^{14}$, $R^{15}$, $R^{16}$, $R^{18}$, $R^{19}$, $R^{21}$ are each independently hydrogen or selected from the group comprising $C_1$-$C_2$ alkyl, carboxaldehyde, hydroxyalkyl, carboxyl, aminoalkyl, alkylaminoalkyl hydroxyalkylfurylalkyl, alkyloxy, alkoxyalkyl, alkylcarbonylalkenyl, alkylcarbonyloxyalkyl, alkyloxycarbonylalkenyl, alkenylcarbonyloxyalkyl, oxiranyl, isocyanate, isocyanate-alkyl, alkylcarboxy, alkenylcarboxy, alkylcarbonyl, alkenylcarbonyl, halocarbonyl, haloalkyl, haloaryl, haloalkenyl, imino, thioalkyl, alkylthioalkyl, cyano and any mixtures thereof, whereby each group is optionally substituted with one or more substituents selected from $C_1$-$C_2$ alkyl, $C_2$-$C_4$ alkenyl, $C_2$-$C_4$ alkynyl, hydroxyl, carboxyl, nitro, amino, alkylfuryl, hydroxyalkylfurylalkyl, isocyanate, formyl, halocarbonyl, and thiol, wherein $R^1$, $R^8$, $R^{17}$ and $R^{20}$ are each independently selected from the group comprising $C_1$-$C_2$ alkyl, carboxaldehyde, hydroxyalkyl, carboxyl, aminoalkyl, alkylaminoalkyl, hydroxyalkylfurylalkyl, alkyloxy, alkoxyalkyl, alkylcarbonylalkenyl, alkylcarbonyloxyalkyl, alkyloxycarbonylalkenyl, alkenylcarbonyloxyalkyl, oxiranyl, isocyanate, isocyanate-alkyl, alkylcarboxy, alkenylcarboxy, alkylcarbonyl, alkenylcarbonyl, halocarbonyl, haloalkyl, haloaryl, haloalkenyl, imino, thioalkyl, alkylthioalkyl, cyano and any mixtures thereof, whereby each group is optionally substituted with one or more substituents selected from $C_1$-$C_2$ alkyl, $C_2$-$C_4$ alkenyl, $C_2$-$C_4$ alkynyl, hydroxyl, carboxyl, nitro, amino, alkylfuryl, hydroxyalkylfurylalkyl, isocyanate, formyl, halocarbonyl, and thiol, and wherein the dotted line represents a double bond.

In another preferred embodiment the invention relates to the use of a composition comprising a compound of formula I and/or formula II wherein n is an integer between 0 and 5 wherein t and s each independently are 1 or 2, wherein w and z each independently are 0 or 1, wherein X and Y are each independently O, S or N—$R^{21}$ and wherein $R^2$, $R^3$, $R^4$, $R^5$, $R^6$, $R^7$, $R^9$, $R^{10}$, $R^{11}$, $R^{12}$, $R^{13}$, $R^{14}$, $R^{15}$, $R^{16}$, $R^{18}$, $R^{19}$, $R^{21}$ are each independently hydrogen or selected from the group comprising $C_1$-$C_2$ alkyl, carboxaldehyde, hydroxyalkyl, carboxyl, aminoalkyl, alkylaminoalkyl hydroxyalkylfurylalkyl, alkoxyalkyl, oxiranyl and isocyanate, wherein $R^1$, $R^8$, $R^{17}$ and $R^{20}$ are each independently selected from the group comprising $C_1$-$C_2$ alkyl, carboxaldehyde, hydroxyalkyl, carboxyl, aminoalkyl, alkylaminoalkyl, hydroxyalkylfurylalkyl, alkoxyalkyl, oxiranyl and isocyanate, and wherein the dotted line represents a double bond.

In another preferred embodiment of the invention the a composition is used comprising a compound of formula I and/or formula II, wherein n is 0, 1, 2, 3, 4, or 5, wherein t is 1 or 2, wherein s is 1 or 2, wherein w is 0 or 1, wherein z is 0 or 1, wherein X is O, S or N—$R^{21}$, and wherein Y is O, S or N—$R^{21}$;

wherein $R^1$ is hydrogen or selected from the group comprising $C_1$-$C_8$ alkyl, $C_2$-$C_8$ alkenyl, carboxaldehyde, hydroxyalkyl, carboxyl, formyl, aminoalkyl, alkylaminoalkyl, furylalkyl, hydroxyalkylfurylalkyl, alkylcarboxy, alkenylcarboxy, alkylcarbonyloxyalkyl, alkenylcarbonyloxyalkyl, isocyanate, isocyanate-alkyl, and even more preferred is —$CH_3$, —$C_2H_5$, —$C_3H_7$, —$C_4H_9$, —$CH_2$=CH, —$CH_2OH$, —$CH_2NH_2$, —COOH, —C(=O)H, —$NO_2$, —$C_2H_3O$, —$CH_2NH_2$, —N=C=O, —$CH_3$—N=C=O, —O—CH=$CH_2$, —C(=O)$OCH_3$, —C(=O)$OC_2H_5$, —$CH_2$-furyl-$CH_2OH$ or —$CH_2$—O—C(=O)—CH=$CH_2$, wherein $R^2$ is hydrogen or selected from the group comprising $C_1$-$C_8$ alkyl, $C_2$-$C_8$ alkenyl, carboxaldehyde, hydroxyalkyl, carboxyl, formyl, aminoalkyl, alkylaminoalkyl, furylalkyl, hydroxyalkylfurylalkyl, alkylcarboxy, alkenylcarboxy, alkylcarbonyloxyalkyl, alkenylcarbonyloxyalkyl, isocyanate, isocyanate-alkyl, and even more preferred is —$CH_3$, —$C_2H_5$, —$C_3H_7$, —$C_4H_9$, —$CH_2$=CH, —$CH_2OH$, —$CH_2NH_2$, —COOH, —C(=O)H, —$NO_2$, —$C_2H_3O$, —$CH_2NH_2$, —N=C=O, —$CH_3$—N=C=O, —O—CH=$CH_2$, —C(=O)$OCH_3$, —C(=O)$OC_2H_5$, —$CH_2$-furyl-$CH_2OH$ or —$CH_2$—O—C(=O)—CH=$CH_2$, wherein $R^3$ is hydrogen or selected from the group comprising $C_1$-$C_8$ alkyl, $C_2$-$C_8$ alkenyl, carboxaldehyde, hydroxyalkyl, carboxyl, formyl, aminoalkyl, alkylaminoalkyl, furylalkyl, hydroxyalkylfurylalkyl, alkylcarboxy, alkenylcarboxy, alkylcarbonyloxyalkyl, alkenylcarbonyloxyalkyl, isocyanate, isocyanate-alkyl, and even more preferred is —$CH_3$, —$C_2H_5$, —$C_3H_7$, —$C_4H_9$, —$CH_2$=CH, —$CH_2OH$, —$CH_2NH_2$, —COOH, —C(=O)H, —$NO_2$, —$C_2H_3O$, —$CH_2NH_2$, —N=C=O, —$CH_3$—N=C=O, —O—CH=$CH_2$, —C(=O)$OCH_3$, —C(=O)$OC_2H_5$, —$CH_2$-furyl-$CH_2OH$ or —$CH_2$—O—C(=O)—CH=$CH_2$, wherein $R^4$ is hydrogen or selected from the group comprising $C_1$-$C_8$ alkyl, $C_2$-$C_8$ alkenyl, carboxaldehyde, hydroxyalkyl, carboxyl, formyl, aminoalkyl, alkylaminoalkyl, furylalkyl, hydroxyalkylfurylalkyl, alkylcarboxy, alkenylcarboxy, alkylcarbonyloxyalkyl, alkenylcarbonyloxyalkyl, isocyanate, isocyanate-alkyl, and even more preferred is —$CH_3$, —$C_2H_5$, —$C_3H_7$, —$C_4H_9$, —$CH_2$=CH, —$CH_2OH$, —$CH_2NH_2$, —COOH, —C(=O)H, —$NO_2$, —$C_2H_3O$, —$CH_2NH_2$, —N=C=O, —$CH_3$—N=C=O, —O—CH=$CH_2$, —C(=O)$OCH_3$, —C(=O)$OC_2H_5$, —$CH_2$-furyl-$CH_2OH$ or —$CH_2$—O—C(=O)—CH=$CH_2$, wherein $R^5$ is hydrogen or selected from the group comprising $C_1$-$C_8$ alkyl, $C_2$-$C_8$ alkenyl, carboxaldehyde, hydroxyalkyl, carboxyl, formyl, aminoalkyl, alkylaminoalkyl, furylalkyl, hydroxyalkylfurylalkyl, alkylcarboxy, alkenylcarboxy, alkylcarbonyloxyalkyl, alkenylcarbonyloxyalkyl, isocyanate, isocyanate-alkyl, and even more preferred is —$CH_3$, —$C_2H_5$, —$C_3H_7$, —$C_4H_9$, —$CH_2$=CH, —$CH_2OH$, —$CH_2NH_2$, —COOH, —C(=O)H, —$NO_2$, —$C_2H_3O$, —$CH_2NH_2$, —N=C=O, —$CH_3$—N=C=O, —O—CH=$CH_2$, —C(=O)$OCH_3$, —C(=O)$OC_2H_5$, —$CH_2$-furyl-$CH_2OH$ or —$CH_2$—O—C(=O)—CH=$CH_2$, wherein $R^6$ is hydrogen or selected from the group comprising $C_1$-$C_8$ alkyl, $C_2$-$C_8$ alkenyl, carboxaldehyde, hydroxyalkyl, carboxyl, formyl, aminoalkyl, alkylaminoalkyl, furylalkyl, hydroxyalkylfurylalkyl, alkylcarboxy, alkenylcarboxy, alkylcarbonyloxyalkyl, alkenylcarbonyloxyalkyl, isocyanate, isocyanate-alkyl, and even more preferred is —$CH_3$, —$C_2H_5$, —$C_3H_7$, —$C_4H_9$, —$CH_2$=CH, —$CH_2OH$, —$CH_2NH_2$, —COOH, —C(=O)H, —$NO_2$, —$C_2H_3O$, —$CH_2NH_2$, —N=C=O, —$CH_3$—N=C=O, —O—CH=$CH_2$, —C(=O)$OCH_3$, —C(=O)$OC_2H_5$, —$CH_2$-furyl-$CH_2OH$ or —$CH_2$—O—C(=O)—CH=$CH_2$, wherein $R^7$ is hydrogen or selected from the group comprising $C_1$-$C_8$ alkyl, $C_2$-$C_8$ alkenyl, carboxaldehyde, hydroxyalkyl, carboxyl, formyl, aminoalkyl, alkylaminoalkyl, furylalkyl, hydroxyalkylfurylalkyl, alkylcarboxy, alkenylcarboxy, alkylcarbonyloxyalkyl, alkenylcarbonyloxyalkyl, isocyanate, isocyanate-alkyl, and even more preferred is —$CH_3$, —$C_2H_5$, —$C_3H_7$, —$C_4H_9$, —$CH_2$=CH, —$CH_2OH$, —$CH_2NH_2$, —COOH, —C(=O)H, —$NO_2$, —$C_2H_3O$, —$CH_2NH_2$, —N=C=O, —$CH_3$—N=C=O, —O—CH=$CH_2$, —C(=O)$OCH_3$, —C(=O)$OC_2H_5$, —$CH_2$-furyl-$CH_2OH$ or —$CH_2$—O—C(=O)—CH=$CH_2$, wherein $R^8$ is hydrogen or selected from the group comprising $C_1$-$C_8$ alkyl, $C_2$-$C_8$ alkenyl, carboxaldehyde, hydroxyalkyl, carboxyl, formyl, aminoalkyl, alkylaminoalkyl, furylalkyl, hydroxyalkylfurylalkyl, alkylcarboxy, alkenylcarboxy, alkylcarbonyloxyalkyl, alkenylcarbonyloxyalkyl, isocyanate, isocyanate-alkyl, and even more preferred is —$CH_3$, —$C_2H_5$, —$C_3H_7$, —$C_4H_9$, —$CH_2$=CH, —$CH_2OH$, —$CH_2NH_2$, —COOH, —C(=O)H, —$NO_2$, —$C_2H_3O$, —$CH_2NH_2$, —N=C=O, —$CH_3$—N=C=O, —O—CH=$CH_2$, —C(=O)$OCH_3$, —C(=O)$OC_2H_5$, —$CH_2$-furyl-$CH_2OH$ or —$CH_2$—O—C(=O)—CH=$CH_2$, wherein $R^9$ is hydrogen or selected from the group comprising $C_1$-$C_8$ alkyl, $C_2$-$C_8$ alkenyl, carboxaldehyde, hydroxyalkyl, carboxyl, formyl, aminoalkyl, alkylaminoalkyl, furylalkyl, hydroxyalkylfurylalkyl, alkylcarboxy, alkenylcarboxy, alkylcarbonyloxyalkyl, alkenylcarbonyloxyalkyl, isocyanate, isocyanatealkyl, and even more preferred is —$CH_3$, —$C_2H_5$, —$C_3H_7$, —$C_4H_9$, —$CH_2$=CH, —$CH_2OH$, —$CH_2NH_2$, —COOH, —C(=O)H, —$NO_2$, —$C_2H_3O$, —$CH_2NH_2$, —N=C=O, —$CH_3$—N=C=O, —O—CH=$CH_2$, —C(=O)$OCH_3$, —C(=O)$OC_2H_5$, —$CH_2$-furyl-$CH_2OH$ or —$CH_2$—O—C(=O)—CH=$CH_2$, wherein $R^{10}$ is hydrogen or selected from the group comprising $C_1$-$C_8$ alkyl, $C_2$-$C_8$ alkenyl, carboxaldehyde, hydroxyalkyl, carboxyl, formyl, aminoalkyl, alkylaminoalkyl, furylalkyl, hydroxyalkylfurylalkyl, alkylcarboxy, alkenylcarboxy, alkylcarbonyloxyalkyl, alkenylcarbonyloxyalkyl, isocyanate, isocyanate-alkyl, and even more preferred is —$CH_3$, —$C_2H_5$, —$C_3H_7$, —$C_4H_9$, —$CH_2$=CH, —$CH_2OH$, —$CH_2NH_2$, —COOH, —C(=O)H, —$NO_2$, —$C_2H_3O$, —$CH_2NH_2$, —N=C=O, —$CH_3$—N=C=O, —O—CH=$CH_2$, —C(=O)$OCH_3$, —C(=O)$OC_2H_5$, —$CH_2$-furyl-$CH_2OH$ or —$CH_2$—O—C(=O)—CH=$CH_2$, wherein $R^{11}$ is hydrogen or selected from the group comprising $C_1$-$C_8$ alkyl, $C_2$-$C_8$ alkenyl, carboxaldehyde, hydroxyalkyl, carboxyl, formyl, aminoalkyl, alkylaminoalkyl, furylalkyl, hydroxyalkylfurylalkyl, alkylcarboxy, alkenylcarboxy, alkylcarbonyloxyalkyl, alkenylcarbonyloxyalkyl, isocyanate, isocyanate-alkyl, and even more preferred is —$CH_3$, —$C_2H_5$, —$C_3H_7$, —$C_4H_9$, —$CH_2$=CH, —$CH_2OH$, —$CH_2NH_2$, —COOH, —C(=O)H, —$NO_2$, —$C_2H_3O$, —$CH_2NH_2$, —N=C=O, —$CH_3$—N=C=O, —O—CH=$CH_2$, —C(=O)$OCH_3$, —C(=O)$OC_2H_5$, —$CH_2$-furyl-$CH_2OH$ or —$CH_2$—O—C(=O)—CH=$CH_2$, wherein $R^{12}$ is hydrogen or selected from the group comprising $C_1$-$C_8$ alkyl, $C_2$-$C_8$ alkenyl, carboxaldehyde, hydroxyalkyl, carboxyl, formyl, aminoalkyl, alkylaminoalkyl, furylalkyl, hydroxyalkylfurylalkyl, alkylcarboxy, alkenylcarboxy, alkylcarbonyloxyalkyl, alkenylcarbonyloxyalkyl, isocyanate, isocyanate-alkyl, and even more preferred is —$CH_3$, —$C_2H_5$, —$C_3H_7$, —$C_4H_9$, —$CH_2$=CH, —$CH_2OH$, —$CH_2NH_2$, —COOH, —C(=O)H, —$NO_2$, —$C_2H_3O$, —$CH_2NH_2$, —N=C=O, —$CH_3$—N=C=O, —O—CH=$CH_2$, —C(=O)$OCH_3$, —C(=O)$OC_2H_5$, —$CH_2$-furyl-$CH_2OH$ or —$CH_2$—O—C(=O)—CH=$CH_2$, wherein $R^{13}$ is hydrogen or selected from the group comprising $C_1$-$C_8$ alkyl, $C_2$-$C_8$ alkenyl, carboxaldehyde, hydroxyalkyl, carboxyl, formyl, aminoalkyl, alkylaminoalkyl, furylalkyl, hydroxyalkylfurylalkyl, alkylcarboxy, alkenylcarboxy, alkylcarbonyloxyalkyl, alkenylcarbonyloxyalkyl, isocyanate, isocyanate-alkyl, and even more preferred is —$CH_3$, —$C_2H_5$, —$C_3H_7$, —$C_4H_9$, —$CH_2$=CH, —$CH_2OH$, —$CH_2NH_2$, —COOH, —C(=O)H, —$NO_2$, —$C_2H_3O$, —$CH_2NH_2$, —N=C=O, —$CH_3$—N=C=O, —O—CH=$CH_2$, —C(=O)$OCH_3$, —C(=O)$OC_2H_5$, —$CH_2$-furyl-$CH_2OH$ or —$CH_2$—O—C(=O)—CH=$CH_2$, wherein $R^{14}$ is hydrogen or selected from the group comprising $C_1$-$C_8$ alkyl, $C_2$-$C_8$ alkenyl, carboxaldehyde, hydroxyalkyl, carboxyl, formyl, aminoalkyl, alkylaminoalkyl, furylalkyl, hydroxyalkylfurylalkyl, alkylcarboxy, alkenylcarboxy, alkylcarbonyloxyalkyl, alkenylcarbonyloxyalkyl, isocyanate, isocyanate-alkyl, and even more preferred is —$CH_3$, —$C_2H_5$, —$C_3H_7$, —$C_4H_9$, —$CH_2$=CH, —$CH_2OH$, —$CH_2NH_2$, —COOH, —C(=O)H, —$NO_2$, —$C_2H_3O$, —$CH_2NH_2$, —N=C=O, —$CH_3$—N=C=O, —O—CH=$CH_2$, —C(=O)$OCH_3$, —C(=O)$OC_2H_5$, —$CH_2$-furyl-$CH_2OH$ or —$CH_2$—O—C(=O)—CH=$CH_2$, wherein $R^{15}$ is hydrogen or selected from the group comprising $C_1$-$C_8$ alkyl, $C_2$-$C_8$ alkenyl, carboxaldehyde, hydroxyalkyl, carboxyl, formyl, aminoalkyl, alkylaminoalkyl, furylalkyl, hydroxyalkylfurylalkyl, alkylcarboxy, alkenylcarboxy, alkylcarbonyloxyalkyl, alkenylcarbonyloxyalkyl, isocyanate, isocyanate-alkyl, and even more preferred is —$CH_3$, —$C_2H_5$, —$C_3H_7$, —$C_4H_9$, —$CH_2$=CH, —$CH_2OH$, —$CH_2NH_2$, —COOH, —C(=O)H, —$NO_2$, —$C_2H_3O$, —$CH_2NH_2$, —N=C=O, —$CH_3$—N=C=O, —O—CH=$CH_2$, —C(=O)$OCH_3$, —C(=O)$OC_2H_5$, —$CH_2$-furyl-$CH_2OH$ or —$CH_2$—O—C(=O)—CH=$CH_2$, wherein $R^{16}$ is hydrogen or selected from the group comprising $C_1$-$C_8$ alkyl, $C_2$-$C_8$ alkenyl, carboxaldehyde, hydroxyalkyl, carboxyl, formyl, aminoalkyl, alkylaminoalkyl, furylalkyl, hydroxyalkylfurylalkyl, alkylcarboxy, alkenylcarboxy, alkylcarbonyloxyalkyl, alkenylcarbonyloxyalkyl, isocyanate, isocyanate-alkyl, and even more preferred is —$CH_3$, —$C_2H_5$, —$C_3H_7$, —$C_4H_9$, —$CH_2$=CH, —$CH_2OH$, —$CH_2NH_2$, —COOH, —C(=O)H, —$NO_2$, —$C_2H_3O$, —$CH_2NH_2$, —N=C=O, —$CH_3$—N=C=O, —O—CH=$CH_2$, —C(=O)$OCH_3$, —C(=O)$OC_2H_5$, —$CH_2$-furyl-$CH_2OH$ or —$CH_2$—O—C(=O)—CH=$CH_2$, wherein $R^{17}$ is selected from the group comprising $C_1$-$C_8$ alkyl, $C_2$-$C_8$ alkenyl, carboxaldehyde, hydroxyalkyl, carboxyl, formyl, aminoalkyl, alkylaminoalkyl, furylalkyl, hydroxyalkylfurylalkyl, alkylcarboxy, alkenylcarboxy, alkylcarbonyloxyalkyl, alkenylcarbonyloxyalkyl, isocyanate, isocyanate-alkyl, and even more preferred is —$CH_3$, —$C_2H_5$, —$C_3H_7$, —$C_4H_9$, —$CH_2$=CH, —$CH_2OH$, —$CH_2NH_2$, —COOH, —C(=O)H, —$NO_2$, —$C_2H_3O$, —$CH_2NH_2$, —N=C=O, —$CH_3$—N=C=O, —O—CH=$CH_2$, —C(=O)$OCH_3$, —C(=O)$OC_2H_5$, —$CH_2$-furyl-$CH_2OH$ or —$CH_2$—O—C(=O)—CH=$CH_2$, wherein $R^{18}$ is hydrogen or selected from the group comprising $C_1$-$C_8$ alkyl, $C_2$-$C_8$ alkenyl, carboxaldehyde, hydroxyalkyl, carboxyl, formyl, aminoalkyl, alkylaminoalkyl, furylalkyl, hydroxyalkylfurylalkyl, alkylcarboxy, alkenylcarboxy, alkylcarbonyloxyalkyl, alkenylcarbonyloxyalkyl, isocyanate, isocyanate-alkyl, and even more preferred is —$CH_3$, —$C_2H_5$, —$C_3H_7$, —$C_4H_9$, —$CH_2$=CH, —$CH_2OH$, —$CH_2NH_2$, —COOH, —C(=O)H, —$NO_2$, —$C_2H_3O$, —$CH_2NH_2$, —N=C=O, —$CH_3$—N=C=O, —O—CH=$CH_2$, —C(=O)$OCH_3$, —C(=O)$OC_2H_5$, —$CH_2$-furyl-$CH_2OH$ or —$CH_2$—O—C(=O)—CH=$CH_2$, wherein $R^{19}$ is hydrogen or selected from the group comprising $C_1$-$C_8$ alkyl, $C_2$-$C_8$ alkenyl, carboxaldehyde, hydroxyalkyl, carboxyl, formyl, aminoalkyl, alkylaminoalkyl, furylalkyl, hydroxyalkylfurylalkyl, alkylcarboxy, alkenylcarboxy, alkylcarbonyloxyalkyl, alkenylcarbonyloxyalkyl, isocyanate, isocyanate-alkyl, and even more preferred is —$CH_3$, —$C_2H_5$, —$C_3H_7$, —$C_4H_9$, —$CH_2$=CH, —$CH_2OH$, —$CH_2NH_2$, —COOH, —C(=O)H, —$NO_2$, —$C_2H_3O$, —$CH_2NH_2$, —N=C=O, —$CH_3$—N=C=O, —O—CH=$CH_2$, —C(=O)$OCH_3$, —C(=O)$OC_2H_5$, —$CH_2$-furyl-$CH_2OH$ or —$CH_2$—O—C(=O)—CH=$CH_2$, wherein $R^{20}$ is selected from the group comprising $C_1$-$C_8$ alkyl, $C_2$-$C_8$ alkenyl, carboxaldehyde, hydroxyalkyl, carboxyl, formyl, aminoalkyl, alkylaminoalkyl, furylalkyl, hydroxyalkylfurylalkyl, alkylcarboxy, alkenylcarboxy, alkylcarbonyloxyalkyl, alkenylcarbonyloxyalkyl, isocyanate, isocyanate-alkyl, and even more preferred is —$CH_3$, —$C_2H_5$, —$C_3H_7$, —$C_4H_9$, —$CH_2$=CH, —$CH_2OH$, —$CH_2NH_2$, —COOH, —C(=O)H, —$NO_2$, —$C_2H_3O$, —$CH_2NH_2$, —N=C=O, —$CH_3$—N=C=O, —O—CH=$CH_2$, —C(=O)$OCH_3$, —C(=O)$OC_2H_5$, —$CH_2$-furyl-$CH_2OH$ or —$CH_2$—O—C(=O)—CH=$CH_2$, wherein $R^{21}$ is hydrogen or selected from the group comprising $C_1$-$C_8$ alkyl, $C_2$-$C_8$ alkenyl, carboxaldehyde, hydroxyalkyl, carboxyl, formyl, aminoalkyl, alkylaminoalkyl, furylalkyl, hydroxyalkylfurylalkyl, alkylcarboxy, alkenylcarboxy, alkylcarbonyloxyalkyl, alkenylcarbonyloxyalkyl, isocyanate, isocyanate-alkyl, and even more preferred is —$CH_3$, —$C_2H_5$, —$C_3H_7$, —$C_4H_9$, —$CH_2$=CH, —$CH_2OH$, —$CH_2NH_2$, —COOH, —C(=O)H, —$NO_2$, —$C_2H_3O$, —$CH_2NH_2$, —N=C=O, —$CH_3$—N=C=O, —O—CH=$CH_2$, —C(=O)$OCH_3$, —C(=O)$OC_2H_5$, —$CH_2$-furyl-$CH_2OH$ or —$CH_2$—O—C(=O)—CH=$CH_2$, whereby each R group is optionally substituted with one or more substituents selected from $C_1$-$C_{20}$ alkyl, $C_2$-$C_{20}$ alkenyl, $C_2$-$C_{20}$ alkynyl, $C_5$-$C_{24}$ aryl, hydroxyl, carboxyl, nitro, amino, furyl, furylalkyl, alkylfuryl, hydroxyalkylfurylalkyl, isocyanate, formyl, halocarbonyl, thiol, and alkylthio, and preferably by one or more substituents selected from $C_1$-$C_2$ alkyl, $C_2$-$C_4$ alkenyl, $C_2$-$C_4$ alkynyl, hydroxyl, carboxyl, nitro, amino, alkylfuryl, hydroxyalkylfurylalkyl, isocyanate, formyl, halocarbonyl, and thiol, and wherein the dotted line represents a double bond.

In another preferred embodiment, non-limiting examples of furan compounds comprised in a composition according to the invention include but are not limited to 2,5-bis(hydroxymethyl)furan; 2,3,5-tris(hydroxymethyl)furan; 5-methyl-2-furfuryl alcohol, 3-hydroxymethyl-5-methyl-2-furfurylalcohol; 2,2'-(hydroxymethyl)difurylmethane; 2,2',3,3'-(hydroxymethyl)difurylmethane; 2,2',4,4'-(hydroxymethyl) difurylmethane; 5-hydroxymethyl-α-(methyl)furfuryl alcohol; 5-hydroxymethyl-2-furancarboxaldehyde; 3,5-hydroxymethyl-2-furancarboxaldehyde; 4,5-hydroxymethyl-2-furancarboxaldehyde; 5-methyl-2-furancarboxaldehyde; 3-hydroxymethyl-5-methyl-2-furancarboxaldehyde; 5-nitro furfuraldehyde; 2,5-bis(carboxaldehyde)furan; 3-hydroxymethyl-2,5-bis(carboxaldehyde)furan; 4-hydroxymethyl-2,5-bis(carboxaldehyde)furan; 5-hydroxymethyl-2-furoic acid; 5-methyl-2-furoic acid; 5-carboxaldehyde-2-furoic acid; 2,5-furandicarboxylic acid; 2,5-furan diacid dichloride; 2,5-furan dicarboxylic acid dimethyl ester; 5-hydroxymethyl-2-furfurylamine; 5-methyl-2-furfurylamine; 5-carboxaldehyde-2-furfurylamine; 5-carboxy-2-furfurylamine; 2,5-bis(aminomethyl)furan; 5-methyl-2-vinylfuroate; 5-tertbutyl-2-vinyl furoate; 5-methyl-2-vinyl furan; 5-methyl-2-furfurylidene acetone; 5-methyl-2-furyloxirane; 5-methyl-furfuryl vinyl ether; 5-hydroxymethyl-2-ethyl furanacrylate; bis-(2,5-isocyanatemethyl) furan; and bis(2,5-isocyanate) furan; or any mixtures thereof.

In an embodiment, the impregnating composition according to the invention comprises 2,5-bis(hydroxymethyl)furan (BHMF). In another embodiment the impregnating composition according to the invention comprises 2,3,5-tris(hydroxymethyl)furan (THMF). In yet another embodiment the impregnating composition according to the invention comprises 2,2'-hydroxymethyldifurylmethane (HMDM). In still another embodiment the impregnating composition according to the invention comprises 5-hydroxymethyl-2-furfurylamine. In still another embodiment the impregnating composition according to the invention comprises 5-hydroxymethyl-2-furancarboxaldehyde. In still another embodiment the impregnating composition according to the invention comprises 5-methyl-2-furfuryl alcohol. In still another embodiment the impregnating composition according to the invention comprises 5-hydroxymethyl-α-(methyl) furfuryl alcohol. In yet another embodiment the impregnating composition according to the invention comprises 2,2',3,3'-(hydroxymethyl)difurylmethane. In another embodiment the impregnating composition according to the invention comprises 2,2',4,4'-(hydroxymethyl)difurylmethane.

In a further embodiment, the invention relates to the use of a composition comprising 2,5-bis(hydroxymethyl)furan (BHMF), 2,3,5-tris(hydroxymethyl)furan (THMF), and 2,2'-hydroxymethyldifurylmethane (HMDM).

In another further embodiment, the invention relates to the use of a composition comprising 2,5-bis(hydroxymethyl)furan (BHMF); 2,3,5-tris(hydroxymethyl)furan (THMF); and 2,2'-(hydroxymethyl)difurylmethane (HMDM); and optionally condensation products of BHMF, THMF and/or HMDM, and/or mixtures thereof.

The term "condensation product" as used herein refers to a compound with structural formula IV formula IV

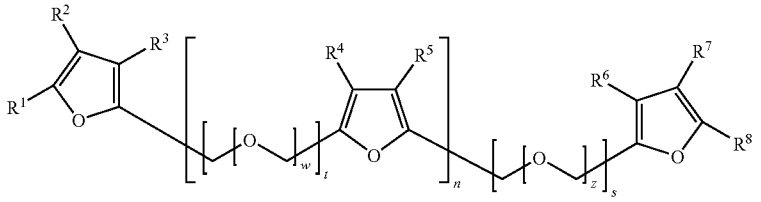

wherein n is preferably between 0 and 5, and more preferably 1, 2, 3 or 4; wherein t is 1 or 2; wherein s is 1 or 2; wherein w is 0 or 1; wherein z is 0 or 1, wherein $R^2$, $R^3$, $R^4$, $R^5$, $R^6$, $R^7$ are each independently hydrogen, methyl, a hydroxyalkyl or a hydroxyalkylfurylalkyl, wherein $R^1$, $R^8$ are each independently selected from the group comprising methyl, hydroxyalkyl, and hydroxyalkylfurylalkyl. In a more preferred embodiment $R^2$, $R^3$, $R^4$, $R^5$, $R^6$, and $R^7$ are each independently —H, —$CH_3$, —$CH_2OH$ or —$CH_2$-furyl-$CH_2OH$ (=hydroxymethylfurylmethyl), and $R^1$ and $R^8$ are each independently —$CH_3$, —$CH_2OH$ or —$CH_2$-furyl-$CH_2OH$.

In another preferred embodiment the invention relates to a polymerizable composition for impregnating and modifying wood comprising a compound of formula I and/or formula II wherein n, t, s, w, z, X, Y, $R^2$, $R^3$, $R^4$, $R^5$, $R^6$, $R^7$, $R^9$, $R^{10}$, $R^{11}$, $R^{12}$, $R^{13}$, $R^{14}$, $R^{15}$, $R^{16}$, $R^{17}$, $R^{18}$, $R^{19}$, $R^{20}$, $R^{21}$ are as defined above, and wherein the dotted line represents a double bond, provided that $R^{17}$ and $R^{20}$ are not a $C_1$-$C_{20}$ alkyl, and preferably not methyl, and r provided that the compound is not 2,5 dimethylfuran, 2,4 dimethylfuran, 2-acetyl-5-methylfuran, 2,5 dimethyl-3-acetylfuran, 2,3,5-trimethylfuran, 2-vinyl-3-methylfuran, 2-methyl benzofuran, dimethylbenzofuran, dibenzofuran, 2,3-dimethyl-5-ethylfuran, 3,4-dimethyl-5-ethylfuran, 2-ethyl-2,3-dihydro-5-methylfuran, 2,5-tetrahydrodimethylfuran, 2-methyltetrahydrofuran-3-one, 2,5-dimethyltetrahydrofuran-3-one, 2-acetyltetrahydrofuran-3-one, 4-methyl-2-furoic acid, 2-(5-methylfuryl)-methyl ketone, 4-methyl furfural, 5-methyl furfural, 2-methyl-3-furfural, 3-methyl-2-furfural, 5-hydroxymethyl-2-furfural, bis furfuryl-2-furan, or 2,5-difurfuryledine-1-cyclopentanone.

Furan compounds according to the invention can be applied in varying amounts in the present composition depending on the wood density and the solid content of the composition comprising substituted furan compounds. It can be adapted according to the desired properties of wood one wants to obtain such as increased density, increased hardness, increased durability, increased fire resistance (FRE or Fire Retardant Efficiency), increased dimensional stability, a desired modulus of elasticity (MOE), improved Anti swelling efficiency (ASE), reduced equilibrium moisture content (EMC), etc. . . .

In a preferred embodiment, the amount of substituted furan compounds in the present composition varies between 3 and 100% by weight and preferably between 10 and 60% by weight.

In another preferred embodiment, the amount of substituted furan compounds being impregnated in the wood varies between 3 and 100% by weight on wood and preferably between 10 and 60% by weight on wood.

Substituted furan compounds in a composition according to the invention are used in an amount such that the weight percentage gain (WPG) of the wood after impregnation and reaction with the wood is at least 3% and for instance can vary from 3% to 150%, more preferably from 5% to 100% and even more preferable between 10% and 60%, and more preferably between 20 and 40% by weight.

In another embodiment, the invention relates to a composition comprising

- more than 60% by weight, and preferably more than 70% by weight of a compound of formula I and/or formula II, wherein n is smaller than or equal to 5, and
- 0 to 40% by weight, preferably 0 to 30% by weight of condensation products thereof.

Preferably, the invention relates to a composition comprising

- more than 70% by weight, preferably more than 80% by weight, and more preferred more than 90% by weight of a compound of formula II,
- 0 to 30% by weight, preferably 0 to 20% by weight, more preferred 0 to 10% by weight of a compound of formula I, wherein n is smaller than or equal to 5, and preferably smaller than or equal to 2, and more preferably 0 or 1, and
- optionally 0 to 40% by weight, preferably 0 to 30% by weight of condensation products thereof.

In a preferred embodiment, the invention provides a composition comprising a mixture of:

- up to 70% by weight, preferably up to 55%, more preferably up to 25% by weight of 2,5-bis(hydroxymethyl) furan (BHMF),
- up to 20% by weight, preferably up to 15%, more preferably up to 5% by weight of 2,3,5-tris(hydroxymethyl) furan (THMF), and
- up to 10% by weight, preferably up to 5%, more preferably up to 1% by weight of 2,2'-hydroxymethyldifuryl-methane (HMDM).

Optionally the composition may further comprise up to 40% by weight, preferably up to 30% by weight of condensation products of BHMF, THMF and/or HMDM.

In another embodiment, the invention relates to a composition comprising:

- up to 60% by weight, and preferably up to 30% by weight of a compound of formula I and/or formula II, wherein n is smaller than or equal to 5, and
- up to 40% by weight, preferably up to 60% by weight of condensation products thereof.

In the present invention the polymerizable impregnation composition contains disubstituted, trisubstituted or polysubstituted furan compounds or a mixture thereof and may contain a solvent, catalyst (initiator), coupling agent, filler, fire retardant, oil(wax) and/or surfactant. In accordance with the present invention the impregnation composition does not set nor react even over extended periods of time, such that it has a long shelf-life. In addition, substituted furan compounds as defined herein, or substituted furan compounds diluted in a solvent are stable in the presence of a catalyst at room temperature.

In a preferred embodiment of the present invention the compounds of the present composition are diluted in a solvent. Preferably the concentration of the furan compounds in such dilution is between 5 and 95 wt %, and more preferably between 10 and 80 wt % Examples of suitable solvents which may be used in a composition according to the invention comprise but are not limited to water, alcohols such as ethanol or methanol, dioxane, N,N dimethylformamide, acetone, ethyleneglycol, or glycerol.

In a more preferred embodiment the solvent is water. The furan compounds according to the invention are preferably water soluble. In a more preferred embodiment the furan compounds according to the invention are water-soluble in presence of a catalyst. As used herein the term "water soluble" refers to the amount that is soluble, after standing at least 48 hours in water at room temperature, when 5.0 grams of furan compounds is added to 95.0 grams deionized water. The percentage of water solubility can be calculated by the formula: % Water solubility=100×(5.0 grams furan compounds−weight of water insoluble residue)/(5.0 grams furan compounds).

In the present invention, the present furan compounds can be reacted with wood in the presence or the absence of a catalyst. The composition according to the invention may thus further comprise a catalyst. The catalysts may be a metallic salt, an ammonium salt, an organic acid, an anhydride, an inorganic acid or any mixtures thereof. In an embodiment the catalysts are metallic salts such as metalhalogenides, metalsulfates, metalnitrates, metalphosphates or their mixtures. Examples are magnesium chloride, magnesium sulfate, magnesium nitrate, zinc chloride, zinc nitrate, aluminum chloride, aluminum nitrate, aluminum sulfate or their mixtures. In another embodiment the catalyst is an ammonium salt. Examples are ammonium chloride, ammonium sulfate, ammonium phosphate, ammonium carbonate, ammonium bicarbonate, ammonium oxalate, ammonium citrate, ammonium nitrate, ammonium fumarate, ammonium levulinate or their mixtures. Other catalysts may be organic acids or inorganic acids. Suitable examples hereof are formic acid, acetic acid, propionic acid, butyric acid, pentanoic acid, hexanoic acid, oxalic acid, maleic acid, maleic anhydride, adipic acid, citric acid, furoic acid, benzoic acid, phthalic anhydride, paratoluene sulphonic acid, hydrochloric acid, sulfuric acid, nitric acid, phosphoric acid, boric acid, silicic acid, benzoylperoxide or their mixtures.

Depending on the type of catalyst and of the curing temperature and desired wood properties, the composition may comprise up to 20% (or more), generally in the range of 1-15%, preferably 8-10%, more preferably 5-8%, yet more preferably 5% by weight on catalyst on the amount of substituted furan compounds in the composition. Catalyst amount is hereby calculated on the amount of "dry" furan compounds.

In another preferred embodiment, several compounds according to the present invention, including but not limited to 2,5-bis(hydroxymethyl)furan (BHMF); 2,3,5-tris(hydroxymethyl)furan (THMF); 2,2'-(hydroxymethyl)difurylmethane; (HMDM); condensation products thereof, 2,2',3,3'-(hydroxymethyl)difurylmethane; 2,2',4,4'-(hydroxymethyl) difurylmethane, are obtained by hydroxymethylation of furfuryl alcohol with a formaldehyde source. The term "formaldehyde source" as used herein refers to formaldehyde, paraformaldehyde, trioxane, or any hemiformal.

Wood Modification Methods

In another embodiment, the invention relates to a method for modifying wood comprising the steps of a) impregnating said wood with a composition as defined herein, and b) reacting said impregnated wood at a temperature of between 70 and 200° C., and for instance between 70 and 150° C.

All methods known in the art can be used for the impregnation of wood with furan compounds according to the present invention.

After impregnation, the wood can be reacted/cured with furan compounds according to the present invention in a curing chamber (e.g. oven, autoclave, kettle, kiln or microwave oven). Several different technical processes may be used for example the vacuum process, vacuum/pressure process or double vacuum process. For deep and uniform penetration, there are several options; non-limiting examples thereof include: a) pressure alone (1 to 10 bar), b) vacuum followed by pressure (full cell process), c) atmospheric or low (1 bar) pressure followed by pressure and then final vacuum (empty-cell process). For difficult-to-penetrate woods like spruce, an oscillating pressure method may be used. In a preferred embodiment the curing and reaction with wood is performed in a curing chamber with a heating system to heat the wood to temperatures above 100° C.

Optionally, the present method may further comprise the step of drying the impregnated wood prior to reacting with heat (=curing) to a moisture content of between 1 and 50% and preferably between 1 and 30% in an oven. This drying step advantageously allows to keep the resin composition according to the present invention in the impregnated wood prior to heating thereof.

In another preferred embodiment, a method is provided wherein the composition is applied at a loading (amount) of between 25 and 1000 kg per $m^3$ wood. More preferably, an amount of composition of between 50 and 500 kg per $m^3$ wood is applied according to the invention.

Times required for all of these processes depend upon many factors, including capability of equipment, size of wood, species of wood and penetration desired. For example impregnation and reaction/curing with wood can be carried out using a full-cell process, which uses an initial vacuum followed by super-atmospheric pressure, which ranges from about 1 to about 20 atmospheres. Initial vacuum can be in the range of from about 5 min. to about 30 min. or more, and super-atmospheric pressure can be in the range of from about 20 min. to about 1 h or more. A curing chamber having a high pressure steam atmosphere, superheated steam or heated air can be used to react furan compounds according to the present invention with the wood. Curing and reaction with wood can be performed with temperatures in the range of from about 70 to 200° C. or from about 70 to about 150° C., preferably between 100 and 140° C. Times will vary with the size and type of the woody material and type of the curing chamber.

The time of curing can be in the range of from about ½ h to about 72 h, in particular from about ½ h to about 48 h preferably from about 3 to 15 h.

In a preferred embodiment, a method is provided wherein the impregnated wood is reacted with a composition as defined herein in step b) at a temperature of between 70 and 200° C., and for instance of at least 70, 80, 90, 100, 110, 120, 130, 140, 150, 160, 170, 180° C. for 1 to 48 hours, and for instance for 3, 6, 9, 12, 15, 18, 24, 30, 36, or 40 hours.

The starting material can be a woody material, usually lumber, which includes plank (thick lumber), but can also be wood composites such as oriented strand board. Woody materials of any dimensions can be utilized.

The impregnation method which can be used in accordance with the present invention can be a full cell process as follows:

i) loading vessel with wood
ii) closing door and drawing an appropriate partial vacuum,
iii) filling the vessel with the present impregnation composition as defined herein, while maintaining vacuum,
iv) pressurizing the submerged wood to a pressure in the range of 5 to 14 bar and at a suitable temperature depending on wood species and other factors,
v) after sufficient time under pressure, reducing pressure to 2 or 3 bar, and expelling the treating fluid with remaining pressure,
vi) releasing all pressure, opening door and removing treated and cured wood.

When impregnation and reaction with wood is complete, the woody material formed by this method has uniform properties throughout. Color, resistance to moisture and deterioration and mechanical properties are consistent throughout. The properties and color of lumber treated this way depend upon type of wood and the loading of furan compounds according to the invention. This can be done by controlling the concentration of furan compounds according to the invention in the impregnation composition. Lumber treated with a higher concentration of furan compounds in the impregnation composition have a darker color, greater hardness, increased durability, increased fire resistance and increased dimensional stability.

In another embodiment, the present invention relates to a method for improving (increasing) durability, dimensional stability, (surface) hardness, density, fire resistance, and/or for reducing equilibrium moisture content (EMC) of wood comprising modifying wood with a composition comprising substituted furan compounds as defined herein by applying a method as defined herein.

In yet another embodiment, the invention provides a method for improving resistance of wood against degradation by biological organisms, by modifying the wood structure without rendering the wood toxic after treatment comprising modifying wood with a composition comprising substituted furan compounds as defined herein by applying a method as defined herein.

Characteristics and Uses of Wood Modified According to the Present Invention

In a further embodiment of this invention, there is provided a wood impregnated and reacted with a composition comprising substituted furan compounds according to the invention. The present invention provides an improved wood so that the impregnating treatment followed by a reaction at high temperature (i.e. curing) improves the dimensional stability, durability and surface hardness, fire retardant efficiency, equilibrium moisture efficiency and anti shrink efficiency of the wood.

The present invention thus relates to wood obtainable by carrying out the method as defined herein.

The present invention also provides wood that is impregnated and reacted with a composition as defined herein. In a preferred embodiment, said wood has a weight percentage gain (WPG) of at least 3%. Substituted furan compounds in a composition according to the invention are used in an amount such that the weight percentage gain (WPG) of the wood after impregnation and reaction with the wood can vary from 3% to 150%, more preferably from 5% to 100% and even more preferable between 10% and 60%, and more preferably between 20 and 40% by weight, and for instance the weight percentage gain (WPG) of the wood is at least 3, 4, 5, 10, 20, 25, 30, 35, 40, 45, 50, 60, 70, 80, 90, 100, 120, or 140%. The parameter WPG is well known in the art of wood modification and indicates how much reacted furan compounds (in weight) are present in the wood after curing. According to common general knowledge (see for instance the Wood Modification: chemical, thermal and other processes/Callum A. S. Hill/John Wiley & Sons Ltd/West Sussex UK/2006) WPG is defined as:

$$WPG(\%)=[(M_m-M_u)/M_u]\times 100$$

With $M_m$=oven dry mass of modified wood $M_u$=oven dry mass of the unmodified wood In another embodiment, wood impregnated and reacted with a composition as defined shows an increase of in density with at least 3% compared to untreated wood, i.e. non impregnated and non reacted wood, and for instance of at least 3, 10, 20, 40, 50, 60, 70 or 150%.

In yet another embodiment, wood impregnated and reacted with a composition as defined shows an improvement in durability with at least one durability class compared to untreated wood, i.e. non impregnated and non reacted wood. Durability can be determined by carrying out tests that are well known in the art of wood modification, such as EN350.

In still another embodiment, wood impregnated and reacted with a composition as defined shows an anti swelling efficiency (ASE) that is comprised between 5 and 100%, and for instance between 10 and 90%, between 20 and 80% or between 25 and 75%. The ASE corresponds to:

$$ASE(\%)=[(S_u-S_m)/S_u]\times 100$$

With $S_m$=swelling coefficient of modified wood $S_u$=swelling coefficient of the unmodified wood Woody material, including cheap types and scrap material, can be used to produce noble wood products such as imitation teak, mahogany, rattan and others, and also provide them with novel properties like durability, fire resistance, shrink efficiency and simpler and reduced maintenance requirements. Wood impregnated and reacted with an impregnation composition according to the invention will not leach furfuryl alcohol, as is the case for prior art wood treated with furfuryl alcohol. At the end-of-life, toxic compounds are not released from the woods according to the invention. In addition, the present wood is a particularly suitable cheaper alternative for tropical hardwoods.

The present invention further encompasses the use of a composition comprising substituted furan compounds according to the invention as knife handles, kitchenware (spoons, forks, cutting boards, bowls), furniture, indoor flooring (parquets), countertops, building parts (facia, cornice, siding, sills, frames, millwork), boat parts (frames, planking, decks, rails, flooring, deck trim, deck flooring, furniture, fittings), marine items (docks, piers, lobster traps, weir poles), outdoor items (furniture, decks, railings and stairs, walkways, boardwalks, playground equipment), bridge parts (beams, railings, decking), gunstocks and pistol grips, musical instrument parts (piano keys, violin and guitar fingerboards and bridges), railway sleepers, cooling tower slats, utility poles, outdoor walkways, flooring, heavy timbers, fenceposts, stakes, highway items (guard rail posts, guard rail plates, sign posts, light poles), containers (tanks buckets), machine parts (conveyor slats, saw guides, saw and planer table tops) joinery parts (window frames, doors).

Other objects, features and advantages of the present invention will become apparent from the following examples. It should be understood, however, that the examples, while indicating specific embodiments of the invention, are given by way of illustration only.

EXAMPLES

Example 1

In this example Scots Pine Sapwood was treated with the following substituted furan compounds according to the invention: 2,5-bis(hydroxymethyl)furan, 5-hydroxymethyl-2-furancarboxaldehyde, 5-hydroxymethyl-2-furfurylamine, 5-methyl-2-furfuryl alcohol, 5-hydroxymethyl-α-(methyl) furfuryl alcohol. These furan compounds were formulated into aqueous impregnation compositions according to Table 1.

TABLE 1

| Impregnation composition | Furan compound | Solvent | Catalyst |
|---|---|---|---|
| 1 | 2,5-bis(hydroxymethyl)furan (22 wt %) | $H_2O$ (77 wt %) | Maleic anhydride (1 wt %) |
| 2 | 5-hydroxymethyl-2-furancarboxaldehyde (22 wt %) | $H_2O$ (77 wt %) | Maleic anhydride (1 wt %) |
| 3 | 5-hydroxymethyl-2-furfurylamine (22 wt %) | $H_2O$ (77 wt %) | Maleic anhydride (1 wt %) |
| 4 | 5-methyl-2-furfuryl alcohol (22 wt %) | MeOH (77 wt %) | Maleic anhydride (1 wt %) |
| 5 | 5-hydroxymethyl-α-(methyl)furfuryl alcohol (22 wt %) | $H_2O$ (77 wt %) | Maleic anhydride (1 wt %) |

Five batches of Scots pine sapwood were impregnated with impregnation compositions 1, 2, 3, 4 or 5 in an impregnation vessel. The wood was treated under 50 mbar absolute for 60 min. Then the impregnation composition was drawn into the vessel under 50 mbar absolute and was left to impregnate the wood for 15 min under 50 mbar absolute. Then the pressure in the vessel was increased to 6 bar absolute for 60 min. Hereafter the pressure phase was ended and the impregnation composition was discharged from the vessel.

The wood was then reacted with the furan compounds under the following reaction conditions: 72 h at 35° C. and 16 h at 130° C. This treatment increased the specific weight of the wood and increased the anti-shrink efficiency (ASE). The ASE was determined as % improvement surface ASE based on the radial and tangential shrinking and swelling compared to non-modified wood (table 2). The Weight percent gain (WPG) corresponds to (density modified wood−density non-modified wood)/density non-modified wood (see also above).

WPG indicates how much reacted furan compounds (in weight) are present in the wood after curing.

TABLE 2

| Impregnation Composition | Density untreated wood | Density treated wood (after impregnation and reaction/curing) | WPG | ASE |
|---|---|---|---|---|
| 1 | 521 (kg/m$^3$) | 668 (kg/m$^3$) | 28% | 46% |
| 2 | 520 (kg/m$^3$) | 650 (kg/m$^3$) | 25% | 40% |
| 3 | 522 (kg/m$^3$) | 659 (kg/m$^3$) | 26% | 5% |
| 4 | 520 (kg/m$^3$) | 670 (kg/m$^3$) | 29% | 50% |
| 5 | 525 (kg/m$^3$) | 669 (kg/m$^3$) | 27% | 44% |

Example 2

In a second example pine sapwood was impregnated and reacted with aqueous mixtures of 2,5-bis(hydroxymethyl) furan (BHMF), 2,3,5-tris(hydroxymethyl)furan (THMF), 2,2'-hydroxymethyldifurylmethane (HMDM) and condensation products of BHMF, THMF and HMDM. The water-soluble furan resin thus contained disubstituted, trisubstituted and polysubstituted furan compounds.

A method to prepare this resin includes the acid catalyzed hydroxymethylation of furfuryl alcohol (FA). Such method is presented below. In this method, a reactor was charged with FA, pF (paraformaldehyde) and adipic acid. The quantities used are shown in Table 3.

TABLE 3

| Total charge of reactants for phase I | | | | |
|---|---|---|---|---|
| | Wt (kg) | Wt (%) | Moles | MW (mol/g) |
| FA | 298 | 61.19 | 3037.7 | 98.10 |
| pF | 174.8 | 35.90 | 5820.8 | 30.03 |
| Adipic acid | 14.16 | 2.91 | 99.90 | 146.14 |
| Total | 502.6 | 100 | | |

Molar ratio (pF/FA) = 1.9

Then the reactor was purged with nitrogen and heated to 117° C. Some pressure was added to the reactor with nitrogen. The free formaldehyde was analyzed at 3 h of reaction and sampled every hour first and then every half hour for the last hour of reaction. The total reaction time was ±5 h. No water insolubles were formed.

Analysis after Phase I: Furfuryl alcohol (FA): ±9.0%; formaldehyde: ±14.5%; 2,5-bis(hydroxymethyl)furan (BHMF): ±38.5%; 2,3,5-tris(hydroxymethyl)furan (THMF): ±4.7%; 2,2'-hydroxymethyldifurylmethane (HMDM): ±0.7%, $H_2O$: ±3.4%, adipic acid: ±2.91%, BHMF, THMF and HMDM: ±26.29%.

In Phase II the remaining furfuryl alcohol and formaldehyde were removed by vacuum distillation. Before distillation mixture was brought to pH 8 by addition of aqueous KOH (25%). Distillation was performed at 140-150° C. under −0.96 bar vacuum. Remaining free formaldehyde was scavenged with an aqueous urea solution and aqueous $NH_3$. The residue of phase II was a water soluble mixture of disubstituted, trisubstituted and polysubstituted furan compounds, including 2,5-bis(hydroxymethyl)furan (BHMF): ±52.0%, 2,3,5-tris(hydroxymethyl)furan (THMF): ±6.4%, 2,2'-hydroxymethyldifurylmethane (HMDM): ±1.0% and condensation products of BHMF, THMF and HMDM (±40.6%). This mixture is hereafter called furan resin and was used to impregnate wood.

The present example demonstrates the properties of pine impregnated and reacted with aqueous solutions of this furan resin. The process to impregnate the wood with the impregnation composition, i.e. an aqueous solution of the above-prepared furan resin, and reaction at high temperatures is similar as for example 1. Prior to dilution the resin was mixed with 5% maleic anhydride catalyst. Samples of wood were treated and impregnated with different aqueous concentrations of furan resin. The weight percentage gain (WPG) was measured after treatment. The equilibrium moisture content (EMC) in humid air (95% RH) was measured. The Anti shrink efficiency (ASE) was also measured and compared to the ASE of untreated wood. The Fire retardant efficiency (FRE) was also measured.

Treatment uniformity: The samples were cut apart after treating and their uniformity of treatment evaluated using color change. All the treated samples had uniform dark color throughout when cut.

FRE: A clear fire retardant effect of the wood treated with the furan resin was observed. FRE values of 20% to 55% were measured, which is comparable to the values of a commercial available fire retardant for wood.

EMC: There is a substantial decrease (improvement of the EMC). The EMC of the blank was 27.3%. Treated wood had values lower than the value of the blank and values as low as 20%.

ASE: Anti swelling efficiency (ASE) was remarkably high, even at quite low weight percent gain (WPG) as show on FIG. 1.

DURABILITY: The durability of pine treated with the furan resin was tested in soil contact (ENV 807) and in contact with wood rot fungus *coniphora puteana* (EN 113). Results are given in tables 4 and 5.

TABLE 4

| durability test (ENV 807) on treated and not treated pine | | | |
|---|---|---|---|
| Wood | WPG | Weight loss after 24 weeks | Weight loss after 48 weeks |
| Not treated | 0% | 11.8% | 20.4% |
| Treated | 17% | 0.3% | 1.0% |

TABLE 5

| durability test (EN113) on treated and not treated pine | | |
|---|---|---|
| Wood | WPG | Weight loss after 6 weeks |
| Not treated | 0% | 40% |
| Treated | 29% | 0.2% |
| Treated | 45% | 0% |

The present example shows that a wood treated with a furan resin according to the present invention, exhibits enhanced properties like durability, fire resistance and shrink efficiency and reduced equilibrium moisture content.

Summarised the present example provides an impregnation composition and modification method which has many advantages, including amongst others:

- The composition is a ready-to-use mixture of suitable compounds. An end user does not need to make any mixture of desired compounds.
- The composition is not classified as hazardous and show good stability and shelf-life.
- Use of the present composition in the impregnation process is easy and requires less investment costs: impregnation step can be carried out with lower emissions (requirement for adapted filter systems and the like are less stringend) and the curing step can be performed in standard equipment.

The obtained modified wood product shows excellent characteristics of durability, dimensional stability and surface hardness, and is therefore an ideal substitute for tropical hardwood. Moreover the wood smells like natural wood, shows a more homogenous appearance and has a very low aquatic toxicity.

Example 3

In this example Scots Pine Sapwood was treated with compounds according to the invention having formula II' or formula V. Compounds with formula II are listed in table 6. Compounds with formula V are listed in table 7. These furan compounds were formulated into impregnation compositions similar as explained in example 1. Prior to impregnation the compounds were diluted in an appropriate solvent. After impregnation and curing the wood showed a positive WPG which indicates that the compounds in table 6 and 7 reacted with the wood upon curing at temperatures at least higher than 70° C.

Formula II'

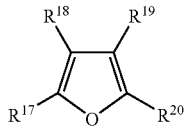

Formula V

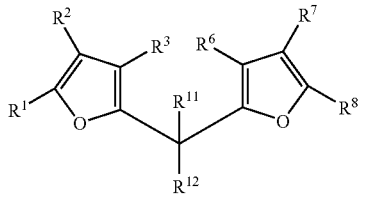

TABLE 6

| Compound | $R^{17}$ | $R^{18}$ | $R^{19}$ | $R^{20}$ |
|---|---|---|---|---|
| 1 2,5-bis(hydroxymethyl)furan | —$CH_2OH$ | —H | —H | —$CH_2OH$ |
| 2 2,3,5-tris(hydroxymethyl)furan | —$CH_2OH$ | —$CH_2OH$ | —H | —$CH_2OH$ |
| 3 5-methyl-2-furfuryl alcohol | —$CH_2OH$ | —H | —H | —$CH_3$ |
| 4 3-hydroxymethyl-5-methyl-2-furfurylalcohol | —$CH_2OH$ | —$CH_2OH$ | —H | —$CH_3$ |
| 5 5-hydroxymethyl-2-furancarboxaldehyde | —C(═O)H | —H | —H | —$CH_2OH$ |
| 6 3,5-hydroxymethyl-2-furancarboxaldehyde | —C(═O)H | —$CH_2OH$ | —H | —$CH_2OH$ |
| 8 4,5-hydroxymethyl-2-furancarboxaldehyde | —C(═O)H | —H | —$CH_2OH$ | —$CH_2OH$ |
| 9 5-methyl-2-furancarboxaldehyde | —C(═O)H | —H | —H | —$CH_3$ |
| 10 3-hydroxymethyl-5-methyl-2-furancarboxaldehyde | —C(═O)H | —$CH_2OH$ | —H | —$CH_3$ |
| 11 5-nitro furfuraldehyde | —C(═O)H | —H | —H | —$NO_2$ |
| 12 2,5-bis(carboxaldehyde)furan | —C(═O)H | —H | —H | —C(═O)H |
| 13 3-hydroxymethyl-2,5-bis(carboxaldehyde)furan | —C(═O)H | —$CH_2OH$ | —H | —C(═O)H |
| 14 4-hydroxymethyl-2,5-bis(carboxaldehyde)furan | —C(═O)H | —H | —$CH_2OH$ | —C(═O)H |
| 15 5-hydroxymethyl-2-furoic acid | —COOH | —H | —H | —$CH_2OH$ |
| 16 5-methyl-2-furoic acid | —COOH | —H | —H | —$CH_3$ |
| 17 5-carboxaldehyde-2-furoic acid | —COOH | —H | —H | —C(═O)H |
| 18 2,5-furandicarboxylic acid | —COOH | —H | —H | —COOH |
| 19 2,5-furan diacid dichloride | —C(═O)Cl | —H | —H | —C(═O)Cl |
| 20 2,5-furan dicarboxylic acid dimethyl ester | —C(═O)$OCH_3$ | —H | —H | —C(═O)$OCH_3$ |
| 21 5-hydroxymethyl-2-furfurylamine | —$CH_2NH_2$ | —H | —H | —$CH_2OH$ |

TABLE 6-continued

| Compound | $R^{17}$ | $R^{18}$ | $R^{19}$ | $R^{20}$ |
|---|---|---|---|---|
| 22 5-methyl-2-furfurylamine | —$CH_2NH_2$ | —H | —H | —$CH_3$ |
| 23 5-carboxaldehyde-2-furfurylamine | —$CH_2NH_2$ | —H | —H | —C(═O)H |
| 25 5-carboxy-2-furfurylamine | —$CH_2NH_2$ | —H | —H | —COOH |
| 26 2,5 bis aminomethyl furan | —$CH_2NH_2$ | —H | —H | —$CH_2NH_2$ |
| 27 5-methyl-2-vinylfuroate | —C(═O)O—CH═$CH_2$ | —H | —H | —$CH_3$ |
| 28 5-tertbutyl-2-vinyl furoate | —C(═O)O—CH═$CH_2$ | —H | —H | —$tC_4H_9$ |
| 29 5-methyl-2-vinyl furan | —$CH_2$═CH | —H | —H | —$CH_3$ |
| 30 5-methyl-2-furfurylidene acetone | —$CH_2$═CH—C(═O)—$CH_3$ | —H | —H | —$CH_3$ |
| 31 5-methyl-2-furyloxirane | —$C_2H_3O$ | —H | —H | —$CH_3$ |
| 32 5-methyl-furfuryl vinyl ether | —O—CH═$CH_2$ | —H | —H | —$CH_3$ |
| 33 5-hydroxymethyl-2-ethyl furanacrylate | —$CH_2$—O—C(═O)—CH═$CH_2$ | —H | —H | —$CH_2OH$ |
| 34 bis-(2,5-isocyanatemethyl) furan | —$CH_3$—N═C═O | —H | —H | $CH_3$—N═C═O |
| 35 bis(2,5-isocyanate) furan | —N═C═O | —H | —H | —N═C═O |
| 36 5-hydroxymethyl-α-(methyl)furfurylalcohol | —CH(—OH)—$CH_3$ | —H | —H | —$CH_2OH$ |
| 37. | —$CH_3$ | —H | —H | —$CH_2OH$ |
| 38. | —$C_2H_5$ | —H | —H | —$CH_2OH$ |
| 39. | —$CH_2$═CH | —H | —H | —$CH_3$ |
| 40. | —$CH_2OH$ | —H | —H | —$CH_3$ |
| 41. | —COOH | —H | —H | —$CH_3$ |
| 42. | —C(═O)H | —H | —H | —$CH_3$ |
| 43. | —$C_2H_3O$ | —H | —H | —COOH |
| 44. | —$CH_2NH_2$ | —H | —H | —COOH |
| 45. | —N═C═O | —H | —H | —COOH |
| 46. | —N═C═O | —H | —H | —N═C═O |
| 47. | —$CH_3$—N═C═O | —H | —H | —$CH_3$—N═C═O |
| 48. | —$C_2H_3O$ | —H | —H | —$C_2H_3O$ |
| 49. | —COOH | —H | —H | —COOH |
| 50. | —$CH_2NH_2$ | —H | —H | —$CH_2NH_2$ |
| 51. | —C(═O)$OCH_3$ | —H | —H | —C(═O)$OCH_3$ |
| 52. | —C(═O)$OC_2H_5$ | —H | —H | —C(═O)$OC_2H_5$ |
| 53. | —$CH_2$OC(═O)H | —H | —H | —$CH_2$OC(═O)H |
| 54. | —$CH_2$OC(═O)$CH_3$ | —H | —H | —$CH_2$OC(═O)$CH_3$ |
| 55. | —$CH_2$OC(═O)CH═$CH_2$ | —H | —H | —$CH_2$OC(═O)CH═$CH_2$ |
| 56. | —$CH_2$OC(═O)C(—$CH_3$)═$CH_2$ | —H | —H | —$CH_2$OC(═O)C(—$CH_3$)═$CH_2$ |
| 57. | —C(═O)$OCH_3$ | —H | —H | —$CH_3$ |
| 58. | —C(═O)$OC_2H_5$ | —H | —H | —$CH_3$ |
| 59. | —$CH_2$OC(═O)H | —H | —H | —$CH_3$ |
| 60. | —$CH_2$OC(═O)$CH_3$ | —H | —H | —$CH_3$ |
| 61. | —$CH_2$OC(═O)CH═$CH_2$ | —H | —H | —$CH_3$ |
| 62. | —$CH_2$OC(═O)C(—$CH_3$)═$CH_2$ | —H | —H | —$CH_3$ |
| 63. | —C(═O)$OCH_3$ | —H | —H | —$CH_2NH_2$ |
| 64. | —$CH_2$═CH | —H | —H | —$CH_2$═CH |
| 65. | —$CH_2$═CH | —H | —H | —N═C═O |
| 66. | —$CH_2NH_2$ | —H | —H | —C(═O)$OCH_3$ |
| 67. | —N═C═O | —H | —H | —C(═O)$OCH_3$ |
| 68. | —$CH_3$—N═C═O | —H | —H | —$CH_2$═CH |
| 69. | —C(═O)$OCH_3$ | —H | —H | —$CH_2$═CH |
| 70. | —$CH_2OH$ | —H | —H | —$CH_2$═CH |
| 71. | —COOH | —H | —H | —$CH_2NH_2$ |
| 72. | —COOH | —H | —H | —N═C═O |
| 73. | —$CH_2NH_2$ | —H | —H | —C(═O)$OCH_3$ |
| 74. | —C(═O)H | —H | —H | —$CH_3$ |
| 75. | —C(═O)H | —H | —H | —$C_2H_5$ |
| 76. | —N═C═O | —H | —H | —$CH_2$═CH |
| 77. | —N═C═O | —H | —H | —C(═O)H |
| 78. | —C(═O)$OCH_3$ | —H | —H | —$NO_2$ |
| 79. | —C(═O)$OCH_3$ | —H | —H | —$C_2H_3O$ |
| 80. | —C(═O)$OCH_3$ | —H | —H | —$CH_2NH_2$ |
| 81. | —C(═O)$OCH_3$ | —H | —H | —N═C═O |

TABLE 6-continued

| Compound | $R^{17}$ | $R^{18}$ | $R^{19}$ | $R^{20}$ |
|---|---|---|---|---|
| 82. | —$CH_2$═CH | —H | —H | —$CH_3$—N═C═O |
| 83. | —$CH_2$═CH | —H | —H | —C(═O)$OCH_3$ |
| 84. | —$CH_2$═CH | —H | —H | —$CH_3$ |
| 85. | —$CH_2$(—$CH_3$)═CH | —H | —H | —$CH_3$ |
| 86. | —$CH_2$(—$CH_3$)═CH | —H | —H | —$CH_2OH$ |
| 87. | —$CH_2$═CH | —H | —H | —$CH_2OH$ |
| 88. | —$CH_2OH$ | —H | —$CH_3$ | —$CH_2OH$ |
| 89. | —$CH_2OH$ | —$CH_2OH$ | —$CH_3$ | —$CH_2OH$ |
| 90. | —$CH_2OH$ | —$CH_2OH$ | —$CH_3$ | —$CH_3$ |
| 91. | —$CH_2OH$ | —$CH_2OH$ | —$CH_2OH$ | —$CH_2OH$ |
| 92. | —$CH_3$ | —$CH_2OH$ | —$CH_2OH$ | —$CH_3$ |
| 93. | —$CH_2NH_2$ | —H | —H | —$CH_3$ |
| 94. | —$CH_2NH_2$ | —$CH_2OH$ | —H | —$CH_3$ |
| 95. | —$CH_2NH_2$ | —H | —$CH_2OH$ | —$CH_3$ |
| 96. | —$CH_2NH_2$ | —H | —$CH_2OH$ | —$CH_2NH_2$ |
| 97. | —$CH_2NH_2$ | —H | —$CH_3$ | —$CH_2NH_2$ |
| 98. | —C(═O)H | —H | —$CH_2OH$ | —$CH_2OH$ |
| 99. | —C(═O)H | —H | —$CH_2OH$ | —C(═O)H |
| 100. | —C(═O)H | —H | —C(═O)H | —C(═O)H |
| 101. | —C(═O)H | —$CH_2OH$ | —H | —$CH_2OH$ |
| 102. | —CH═CH—C(═O)—$CH_3$ | —H | —H | —$CH_3$ |
| 103. | —CH═CH—C(═O)—$CH_3$ | —H | —H | —$CH_2OH$ |
| 104. | —$CH_2OCH_2CH_2OH$ | —H | —H | —$CH_2OH$ |
| 105. | —$CH_2OCH_2CH_2OH$ | —H | —H | —$CH_3$ |
| 106. | —$CH_2OCH_2CH_2OH$ | —H | —$CH_2OH$ | —$CH_2OH$ |
| 107. | —C(═O)H | —H | —$CH_2$═CH | —C(═O)H |
| 108. | —C(═O)H | —H | —$CH_2OH$ | —C(═O)H |
| 109. | —C(═O)H | —H | —COOH | —C(═O)H |
| 110. | —C(═O)H | —H | —C(═O)H | —C(═O)H |
| 111. | —COOH | —H | —$C_2H_3O$ | —COOH |
| 112. | —COOH | —H | —$CH_2NH_2$ | —COOH |
| 113. | —COOH | —H | —N═C═O | —COOH |
| 114. | —$CH_3$ | —H | —$CH_3$—N═C═O | —$CH_3$ |
| 115. | —$CH_3$ | —H | —O—CH═$CH_2$ | —$CH_3$ |
| 116. | —$CH_2NH_2$ | —H | —$CH_2OH$ | —$CH_2NH_2$ |
| 117. | —$CH_2OH$ | —$CH_3$ | —H | —$CH_2OH$ |
| 118. | —$CH_2OH$ | —$C_2H_5$ | —H | —$CH_2OH$ |
| 119. | —C(═O)H | —$CH_2$═CH | —H | —C(═O)H |
| 120. | —$CH_2OH$ | —$CH_2OH$ | —$CH_2OH$ | —$CH_2OH$ |
| 121. | —$CH_2OH$ | —$CH_3$ | —$CH_3$ | —$CH_2OH$ |
| 122. | —C(═O)H | —$CH_2$═CH | —$CH_2$═CH | —C(═O)H |
| 123. | —C(═O)H | —$CH_2OH$ | —$CH_2OH$ | —C(═O)H |
| 124. | —C(═O)H | —COOH | —COOH | —C(═O)H |
| 125. | —C(═O)H | —C(═O)H | —C(═O)H | —C(═O)H |
| 126. | —$CH_3$ | —$CH_3$—N═C═O | —$CH_3$—N═C═O | —$CH_3$ |
| 127. | —$CH_3$ | —O—CH═$CH_2$ | —O—CH═$CH_2$ | —$CH_3$ |
| 128. | —$CH_2NH_2$ | —C(═O)$OCH_3$ | —C(═O)$OCH_3$ | —$CH_2NH_2$ |
| 129. | —$CH_2NH_2$ | —$CH_2OH$ | —$CH_2OH$ | —$CH_2NH_2$ |

TABLE 7

| compound | $R^1$ | $R^2$ | $R^3$ | $R^6$ | $R^7$ | $R^8$ | $R^{11}$ | $R^{12}$ |
|---|---|---|---|---|---|---|---|---|
| 130. | —C(═O)$OCH_3$ | —H | —H | —H | —H | —C(═O)$OCH_3$ | —H | —H |
| 131. | —C(═O)$OC_2H_5$ | —H | —H | —H | —H | —C(═O)$OC_2H_5$ | —H | —H |
| 132. | —$CH_2$OC(═O)H | —H | —H | —H | —H | —$CH_2$OC(═O)H | —H | —H |
| 133. | —$CH_2$OC(═O)$CH_3$ | —H | —H | —H | —H | —$CH_2$OC(═O)$CH_3$ | —H | —H |
| 134. | —$CH_2$OC(═O)CH═$CH_2$ | —H | —H | —H | —H | —$CH_2$OC(═O)CH═$CH_2$ | —H | —H |
| 135. | —$CH_2$OC(═O)C(—$CH_3$)═C | —H | —H | —H | —H | —$CH_2$OC(═O)C(—$CH_3$)═C | —H | —H |
| 136. | —C(═O)$OCH_3$ | —H | —H | —H | —H | —C(═O)$OCH_3$ | —$CH_3$ | —$CH_3$ |
| 137. | —C(═O)$OC_2H_5$ | —H | —H | —H | —H | —C(═O)$OC_2H_5$ | —$CH_3$ | —$CH_3$ |
| 138. | —$CH_2$OC(═O)H | —H | —H | —H | —H | —$CH_2$OC(═O)H | —$CH_3$ | —$CH_3$ |
| 139. | —$CH_2$OC(═O)$CH_3$ | —H | —H | —H | —H | —$CH_2$OC(═O)$CH_3$ | —$CH_3$ | —$CH_3$ |
| 140. | —$CH_2$OC(═O)CH═$CH_2$ | —H | —H | —H | —H | —$CH_2$OC(═O)CH═$CH_2$ | —$CH_3$ | —$CH_3$ |
| 141. | —$CH_2$OC(═O)C(—$CH_3$)═C | —H | —H | —H | —H | —$CH_2$OC(═O)C(—$CH_3$)═C | —$CH_3$ | —$CH_3$ |
| 142. | —$CH_2NH_2$ | —H | —H | —H | —H | —$CH_2NH_2$ | —H | —H |
| 143. | —$CH_2NH_2$ | —H | —H | —H | —H | —$CH_2NH_2$ | —$CH_3$ | —$CH_3$ |
| 144. | —$CH_2OH$ | —H | —H | —H | —H | —$CH_2OH$ | —H | —H |
| 145. | —$CH_2OH$ | —$CH_2OH$ | —H | —$CH_2OH$ | —H | —$CH_2OH$ | —H | —H |
| 146. | —$CH_2OH$ | —$CH_2OH$ | —$CH_2OH$ | —$CH_2OH$ | —$CH_2OH$ | —$CH_2OH$ | —H | —H |
| 147. | —$CH_2OH$ | —H | —H | —H | —H | —$CH_2OH$ | —H | —H |
| 148. | —$CH_3$ | —H | —H | —H | —H | —$CH_3$ | —$CH_3$ | —$CH_3$ |
| 149. | —$CH_3$ | —H | —H | —H | —H | —$CH_3$ | —H | —H |

TABLE 7-continued

| compound | $R^1$ | $R^2$ | $R^3$ | $R^6$ | $R^7$ | $R^8$ | $R^{11}$ | $R^{12}$ |
|---|---|---|---|---|---|---|---|---|
| 150. | —COOH | —H | —H | —H | —H | —COOH | —H | —H |
| 151. | —N═C═O | —H | —H | —H | —H | —N═C═O | —H | —H |
| 152. | —$CH_3$—N═C═O | —H | —H | —H | —H | —$CH_3$—N═C═O | —H | —H |
| 153. | —C(═O)H | —H | —H | —H | —H | —C(═O)H | —H | —H |
| 154. | —$CH_2$═CH | —H | —H | —H | —H | —$CH_2$═CH | —H | —H |
| 155. | —COOH | —H | —H | —H | —H | —COOH | —$CH_3$ | —$CH_3$ |
| 156. | —N═C═O | —H | —H | —H | —H | —N═C═O | —$CH_3$ | —$CH_3$ |
| 157. | —$CH_3$—N═C═O | —H | —H | —H | —H | —$CH_3$—N═C═O | —$CH_3$ | —$CH_3$ |
| 158. | —C(═O)H | —H | —H | —H | —H | —C(═O)H | —$CH_3$ | —$CH_3$ |
| 159. | —$CH_2$═CH | —H | —H | —H | —H | —$CH_2$═CH | —$CH_3$ | —$CH_3$ |
| 160. | —$CH_3$ | —$CH_2OH$ | —H | —H | —H | —$CH_3$ | —H | —H |
| 161. | —COOH | —$CH_2OH$ | —H | —H | —H | —COOH | —H | —H |
| 162. | —N═C═O | —$CH_2OH$ | —H | —H | —H | —N═C═O | —H | —H |
| 163. | —$CH_3$—N═C═O | —$CH_2OH$ | —H | —H | —H | —$CH_3$—N═C═O | —H | —H |
| 164. | —C(═O)H | —$CH_2OH$ | —H | —H | —H | —C(═O)H | —H | —H |
| 165. | —$CH_2$═CH | —$CH_2OH$ | —H | —H | —H | —$CH_2$═CH | —H | —H |

Example 4

In another example pine sapwood (*pinus sylvestris*) was impregnated and reacted with aqueous mixtures of 2,5-bis(hydroxymethyl)furan (BHMF), 2,3,5-tris(hydroxymethyl) furan (THMF), 2,2'-hydroxymethyldifurylmethane (HMDM) and condensation products of BHMF, THMF and HMDM.

A method to prepare this resin included the acid catalyzed hydroxymethylation of furfuryl alcohol (FA). The method of preparation is described in example 2.

Figure 2:
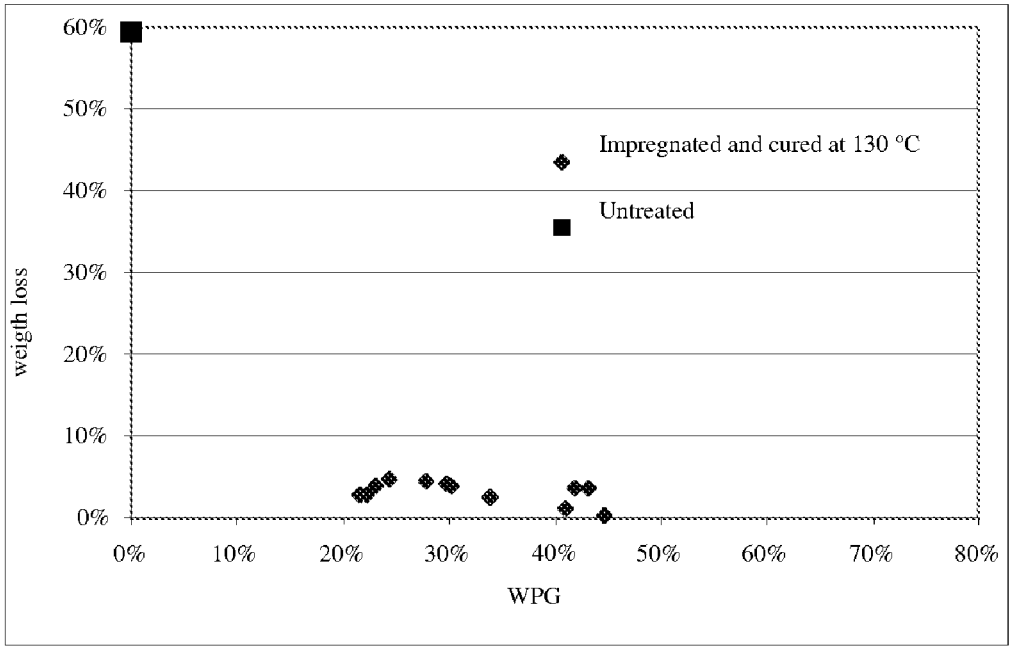
FIG. 2 illustrates the weight loss after 72 weeks soilbox test (EN807) in function of the WPG value.
Figure 3:
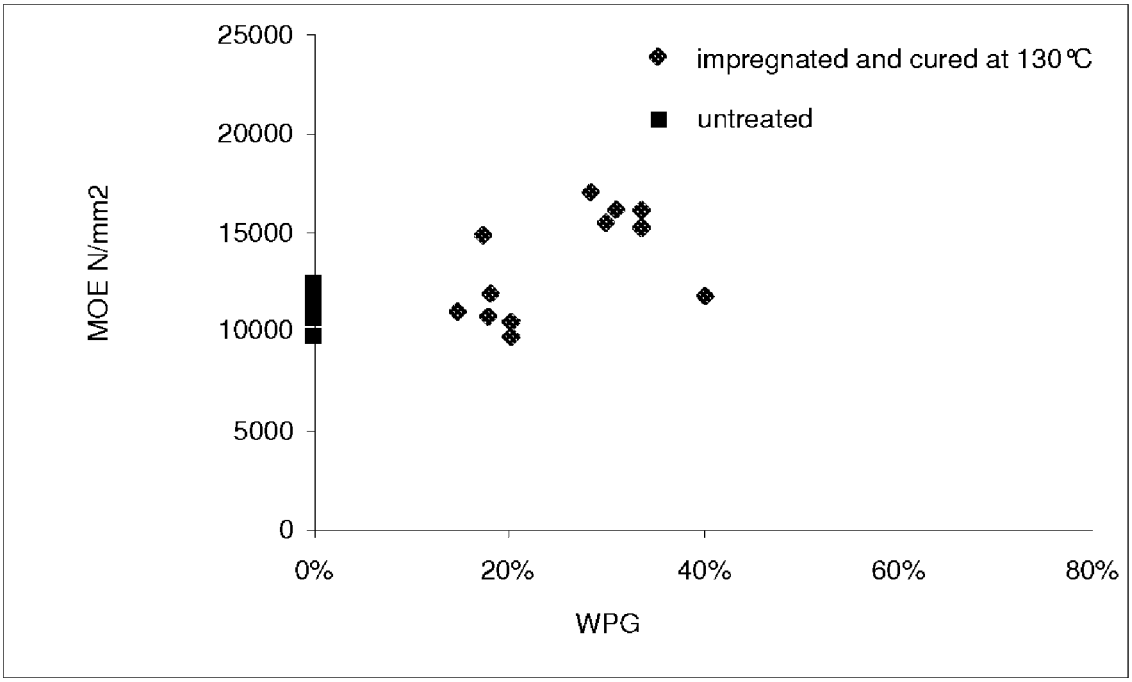
FIG. 3 illustrates the modulus of elasticity (MOE) in function of the WPG value.

The present example demonstrates the properties of pine impregnated and reacted with aqueous solutions of this furan resin. The process to impregnate the wood with the impregnation composition, i.e. an aqueous solution of the above-prepared furan resin, and reaction at high temperatures is similar as for example 1. Prior to dilution the resin was mixed with 5% maleic anhydride catalyst. Samples of wood were treated and impregnated with different aqueous concentrations of furan resin. The weight percentage gain (WPG) was measured after treatment. The durability of the wood was tested after 72 weeks ground contact in an ENV 807 test. FIG. 2 shows the weight loss after 72 weeks soilbox test (EN807) in function of the WPG value. The values of this test were evaluated according to the EN350 method. According to the EN350 method (durability class determination) the treated wood has an x-factor between 0 and 0.1. Wood with an x-factor lower than 0.15 has a durability class of 1 i.e. the highest durability class. Modulus of elasticity was evaluated according to prEN 408. The modulus of elasticity increased with increasing WPG. FIG. 3 illustrates the modulus of elasticity (MOE) in function of the WPG

Example 5

In another example Radiata Pine sapwood was impregnated and reacted with aqueous mixtures of 2,5-bis(hydroxymethyl)furan (BHMF), 2,3,5-tris(hydroxymethyl)furan (THMF), 2,2'-hydroxymethyldifurylmethane (HMDM) and condensation products of BHMF, THMF and HMDM.

A method to prepare this resin includes the acid catalyzed hydroxymethylation of furfuryl alcohol (FA). The method of preparation is described in example 2.

The present example demonstrates the properties of Radiata Pine impregnated and reacted with aqueous solutions of this furan resin. The process to impregnate the wood with the impregnation composition, i.e. an aqueous solution of the above-prepared furan resin, and reaction at high temperatures is similar as for example 1. Prior to dilution the resin was mixed with 5% maleic anhydride catalyst. Samples of wood were treated and impregnated with different aqueous concentrations of furan resin. The weight percentage gain (WPG) was measured after treatment. The durability of the wood was tested after 20 weeks ground contact in the ENV 807 test (Table 8).

TABLE 8

Mass loss of modified Radiata Pine compared to reference samples in the ENV807 test

| Wood species | WPG (%) | Weight loss after 20 weeks (%) |
|---|---|---|
| Reference Beech | / | 57.3 ± 2.4 |
| Reference Azobe | / | 4.3 ± 1.4 |
| Reference Scots Pine (sapwood) | / | 26.8 ± 3.6 |
| Reference Radiata pine | / | 17.91 ± 6.9 |
| Modified Radiata pine | 20 | 3.1 ± 0.4 |
| Modified Radiata pine | 30 | 3.2 ± 0.3 |
| Modified Radiata pine | 50 | 3.1 ± 0.2 |
| Modified Radiata pine | 60 | 3.2 ± 0.2 |
| Modified Radiata pine | 70 | 4.0 ± 0.7 |
| Modified Radiata pine | 85 | 3.0 ± 0.2 |

Cell wall modification can be visualized with fluorescence microscopy. With an excitation wavelength of 488 or 688 nm polyfurfuryl alcohol can be made fluorescent.

Example 6

In another example Pine sapwood was impregnated and reacted with aqueous mixtures of 2,5-bis(hydroxymethyl) furan (BHMF), 2,3,5-tris(hydroxymethyl)furan (THMF), 2,2'-hydroxymethyldifurylmethane (HMDM) and condensation products of BHMF, THMF and HMDM.

A method to prepare this resin includes the acid catalyzed hydroxymethylation of furfuryl alcohol (FA). The method of preparation is described in example 2.

The present example demonstrates the properties of Radiata Pine impregnated and reacted with aqueous solutions of this furan resin. The process to impregnate the wood with the impregnation composition, i.e. an aqueous solution of the above-prepared furan resin, and reaction at high temperatures is similar as for example 1. Prior to dilution the resin was mixed with 5% maleic anhydride catalyst.

As a reference pine sapwood was also treated with a commercial CCA (Copper Chrome Arsenic) wood preservative agent.

Table 9 gives a comparison of toxicity in toxicity units (TU) between unmodified pine, modified pine with 20% wpg and pine treated with a commercial CCA wood preservative agent. Toxicity units are reciprocal values of $EC_{50}$s of *Daphnia Magna* after 24 hrs exposure to leaching water of the wood samples. This procedure is described in OECD TG 202 (1984) standard. Leaching water was produced according to the European standard EN84.

TABLE 9

Comparison of toxicity in toxity units (TU) between unmodified pine, modified pine with 20% wpg and pine treated with a commercial CCA wood preservative agent.

| Sample | TU |
|---|---|
| Unmodified pine sapwood (reference) | <2 |
| Modified pine sapwood (20% wpg) | <2 |
| CCA treated pine sapwood (10 kg/m$^3$) | >16 |

From table 9 it is evident that the modified wood according to the invention does not induce toxicity to *Daphnia Magna* whereas CCA treated wood shows a toxic effect on these crustaceans.

What is claimed is:

1. A method for modifying wood comprising the steps of:

a) impregnating said wood with a polymerizable composition comprising a compound of formula I and/or formula II Formula I

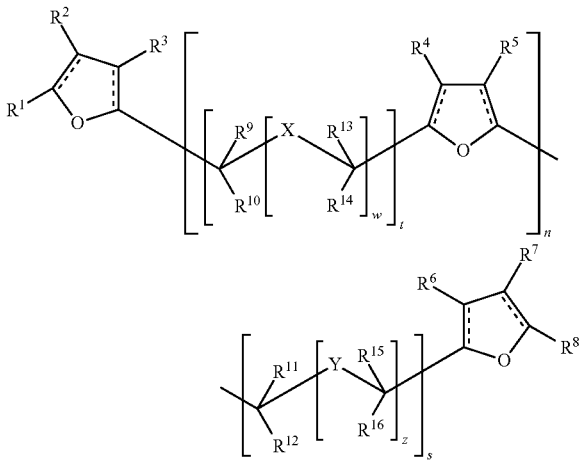

Formula II

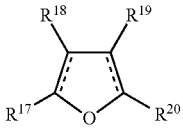

wherein n is 0, 1, 2, 3, 4 or 5, wherein t and s each independently are 1 or 2, wherein w and z each independently are 0 or 1, wherein X and Y each independently are O, S or N—$R^{21}$ and wherein $R^2$, $R^3$, $R^4$, $R^5$, $R^6$, $R^7$, $R^9$, $R^{10}$, $R^{11}$, $R^{12}$, $R^{13}$, $R^{14}$, $R^{15}$, $R^{16}$, $R^{18}$, $R^{19}$, $R^{21}$ are each independently hydrogen or selected from the group consisting of $C_1$-$C_2$ alkyl, carboxaldehyde, hydroxyalkyl, carboxyl, aminoalkyl, alkylaminoalkyl hydroxyalkylfurylalkyl, alkyloxy, alkoxyalkyl, alkylcarbonylalkenyl, alkylcarbonyloxyalkyl, alkyloxycarbonylalkenyl, alkenylcarbonyloxyalkyl, oxiranyl, isocyanate, isocyanate-alkyl, alkylcarboxy, alkenylcarboxy, alkylcarbonyl, alkenylcarbonyl, halocarbonyl, haloalkyl, haloaryl, haloalkenyl, imino, thioalkyl, alkylthioalkyl, cyano and any mixtures thereof, whereby each group is optionally substituted with one or more substituents selected from $C_1$-$C_2$ alkyl, $C_2$-$C_4$ alkenyl, $C_2$-$C_4$ alkynyl, hydroxyl, carboxyl, nitro, amino, alkylfuryl, hydroxyalkylfurylalkyl, isocyanate, formyl, halocarbonyl, and thiol, wherein $R^1$ $R^8$, $R^{17}$ and $R^{20}$ are each independently selected from the group consisting of carboxaldehyde, hydroxyalkyl, carboxyl, aminoalkyl, alkylaminoalkyl, hydroxyalkylfurylalkyl, alkyloxy, alkoxyalkyl, alkylcarbonylalkenyl, alkylcarbonyloxyalkyl, alkyloxycarbonylalkenyl, alkenylcarbonyloxyalkyl, oxiranyl, isocyanate, isocyanate-alkyl, alkylcarboxy, alkenylcarboxy, alkylcarbonyl, alkenylcarbonyl, halocarbonyl, haloalkyl, haloaryl, haloalkenyl, imino, thioalkyl, alkylthioalkyl, cyano and any mixtures thereof, whereby each group is optionally substituted with one or more substituents selected from $C_1$-$C_2$ alkyl, $C_2$-$C_4$ alkenyl, $C_2$-$C_4$ alkynyl, hydroxyl, carboxyl, nitro, amino, alkylfuryl, hydroxyalkylfurylalkyl, isocyanate, formyl, halocarbonyl, and thiol, and wherein the dotted line represents a double bond, wherein said compounds are diluted in water, and wherein said composition further comprises a catalyst which is an ammonium salt, an organic acid, an anhydride, an inorganic acid, magnesium chloride, magnesium sulfate, magnesium nitrate, zinc chloride, zinc nitrate, aluminum chloride, aluminum nitrate, aluminum sulfate or any mixtures thereof, and b) reacting said impregnated wood at a temperature of between 70 and 200° C.

2. The method according to claim 1, wherein said impregnated wood is reacted in step b) at a temperature of between 70 and 150° C. for 1 to 48 hours.

3. The method according to claim 1, wherein said composition is applied at a loading of between 25 and 1000 kg per m$^3$ wood.

4. The method according to claim 1, further comprising the step of drying said impregnated wood prior to reacting to a moisture content of between 1 and 50%.

5. The method according to claim 1, wherein said wood is impregnated in step a) with a polymerizable composition which comprises a compound selected from the group consisting of 2,5-bis(hydroxymethyl)furan; 2,3,5- tris(hydroxymethyl)furan; 5-methyl-2-furfuryl alcohol; 3-hydroxymethyl-5-methyl-2-furfurylalcohol; 2,2'-(hydroxymethyl)difurylmethane; 2,2',3,3'-(hydroxymethyl) difurylmethane; 2,2',4,4'-(hydroxymethyl)difurylmethane; 5-hydroxymethyl-α-(methyl)furfurylalcohol; 5-hydroxymethyl-2-furancarboxaldehyde; 3,5-hydroxymethyl-2-furancarboxaldehyde; 4,5-hydroxymethyl-2-furancarboxaldehyde; 5-hydroxymethyl-2-furfurylamine; 5-methyl-2-furfurylamine; 5-carboxaldehyde-2-furfurylamine; 5-carboxy-2-furfurylamine; 2,5-bis(aminomethyl)furan; 5-hydroxymethyl-2-furancarboxaldehyde; and 5- hydroxymethyl-2-furfurylamine; or any mixtures thereof.

6. The method according to claim 1, wherein said wood is impregnated in step a) with a polymerizable composition comprising a compound selected from the group consisting of 2,5-bis(hydroxymethyl)furan (BHMF); 2,3,5-tris(hydroxymethyl)furan (THMF); 2,2'-(hydroxymethyl)difurylmethane (HMDM); 2,2',3,3'-(hydroxymethyl)difurylmethane; 2,2',4,4'-(hydroxymethyl)difurylmethane; 5-hydroxymethyl-2-furancarboxaldehyde; and 5-hydroxymethyl-2-furfurylamine; and 2,5-bis(aminomethyl)furan, or any mixtures thereof.

7. The method according to claim 1, wherein said wood is impregnated in step a) with a polymerizable composition comprising a compound selected from the group consisting of 2,5-bis(hydroxymethyl)furan (BHMF); 2,3,5- tris(hydroxymethyl)furan (THMF); 2,2'(hydroxymethyl)difurylmethane (HMDM); and optionally condensation products thereof, or mixtures thereof.

8. The method according to claim 7, wherein said compounds are obtained by hydroxymethylation of at least one furfuryl alcohol compound with a formaldehyde source.

9. The method according to claim 1, wherein said compound of formula I and/or formula II is present in said composition in an amount of between 3 and 100% by weight.

10. A method for manufacturing a product comprising constructing the product from wood according to claim 1, wherein the product is selected from the group consisting of knife handles, kitchenware (spoons, forks, cutting boards, bowls), furniture, indoor flooring, countertops, building parts (facia, cornice, siding, sills, frames, millwork), boat parts (frames, planking, decks, rails, flooring, deck trim, deck flooring, furniture, fittings), marine items (docks, piers, lobster traps, weir poles), outdoor items (furniture, decks, railings and stairs, walkways, boardwalks, playground equipment), bridge parts (beams, railings, decking), gunstocks and pistol grips, musical instrument parts (piano keys, violin and guitar fingerboards and bridges), railway sleepers, cooling tower slats, utility poles, outdoor walkways, flooring, heavy timbers, fenceposts, stakes, highway items (guard rail posts, guard rail plates, sign posts, light poles), containers (tanks, buckets), machine parts (conveyor slats, saw guides, saw and planer table tops), joinery parts (window frames, doors).

* * * * *

UNITED STATES PATENT AND TRADEMARK OFFICE

CERTIFICATE OF CORRECTION

PATENT NO. : 8,158,206 B2
APPLICATION NO. : 12/305080
DATED : April 17, 2012
INVENTOR(S) : Van Rhijn et al.

It is certified that error appears in the above-identified patent and that said Letters Patent is hereby corrected as shown below:

On the Title page:

Item (57), Column 2, Line 4, Abstract, "includes di-, tri, and/or" should be changed to --includes di-, tri-, and/or--

In the Specifications:

Column 7, Line 41, "1-2-," should be changed to --1-, 2-,--

Column 7, Line 43, "1, 2-," should be changed to --1-, 2-,--

Column 13, Line 4, "alkylaminoalkyl" should be changed to --alkylaminoalkyl,--

Column 13, Line 44, "alkylaminoalkyl" should be changed to --alkylaminoalkyl,--

Column 13, Line 53, "the invention the a" should be changed to --the invention a--

Column 19, Line 6, "and r provided" should be changed to --and/or provided--

Column 27, Line 3, "stringend) and" should be changed to --stringent) and--

Column 33, Line 52, "of the WPG" should be changed to --of the WPG.--

Column 35, Line 14, "in toxity units" should be changed to --in toxicity units--

In the Claims:

Column 36, Line 3, "alkylaminoalkyl" should be changed to --alkylaminoalkyl,--

Column 36, Line 16, "wherein $R^1$" should be changed to --wherein $R^1$,--

Signed and Sealed this
Twenty-fifth Day of September, 2012

David J. Kappos

David J. Kappos
*Director of the United States Patent and Trademark Office*